US010827849B1

(12) United States Patent
Flannery et al.

(10) Patent No.: US 10,827,849 B1
(45) Date of Patent: Nov. 10, 2020

(54) BED RAIL HAVING CENTER TUBES CONNECTED TO EACH OTHER

(71) Applicant: Regalo International, LLC, Longboat Key, FL (US)

(72) Inventors: Mark A. Flannery, Longboat Key, FL (US); Porter R. Million, Minneapolis, MN (US)

(73) Assignee: Regalo International, LLC, Longboat Key, FL (US)

( * ) Notice: Subject to any disclaimer, the term of this patent is extended or adjusted under 35 U.S.C. 154(b) by 0 days.

(21) Appl. No.: 16/384,809

(22) Filed: Apr. 15, 2019

Related U.S. Application Data

(60) Division of application No. 14/880,226, filed on Oct. 10, 2015, now abandoned, which is a division of application No. 14/635,954, filed on Mar. 2, 2015, now Pat. No. 9,155,400, which is a continuation of application No. 14/052,740, filed on Oct. 12, 2013, now Pat. No. 8,966,682, which is a continuation of application No. 13/269,591, filed on Oct. 8, 2011, now Pat. No. 8,555,436.

(Continued)

(51) Int. Cl.
*A47C 21/08* (2006.01)
*A47D 15/00* (2006.01)

(52) U.S. Cl.
CPC ..... *A47C 21/08* (2013.01); *A47D 15/008* (2013.01)

(58) Field of Classification Search
CPC ..... A47D 7/02; A47C 20/023; A47C 21/08; A61G 7/0507; A61G 7/0508; A61G 7/0509; A61G 7/051; A61G 7/0512; A61G 7/0513; A61G 7/0514; A61G 7/0515; A61G 7/0516; A61G 7/0518; A61G 7/0519; A61G 7/052; A61G 7/0521; A61G 7/0522; A61G 7/0524
See application file for complete search history.

(56) References Cited

U.S. PATENT DOCUMENTS 1,234,804 A 7/1917 Reynolds
2,611,909 A * 9/1952 Dillon ..... A61G 7/0518 5/426

(Continued)

FOREIGN PATENT DOCUMENTS

EP 2430949 A1 3/2012
FR 2076211 10/1971

(Continued)

OTHER PUBLICATIONS

Machine translation of description of FR 2076211, 3 pages dated Jun. 15, 2015.

*Primary Examiner* — Eric J Kurilla
*Assistant Examiner* — Amanda L Bailey

(57) ABSTRACT

A horizontally expandable bed rail having a guard rail frame that confronts a first side of a bed to prevent a child from falling out of the bed. The guard rail frame includes a pair of vertical support members interconnected by upper, lower and intermediate horizontal support members that slide horizontally in and out such that the vertical support members have an extended position where the vertical support members are spaced apart by a first distance and a drawn in position where the vertical support members are spaced apart by a second distance that is less than the first distance.

4 Claims, 16 Drawing Sheets

Related U.S. Application Data

(60) Provisional application No. 61/415,808, filed on Nov. 19, 2010, provisional application No. 61/407,902, filed on Oct. 28, 2010, provisional application No. 61/407,013, filed on Oct. 26, 2010, provisional application No. 61/406,995, filed on Oct. 26, 2010, provisional application No. 61/391,583, filed on Oct. 8, 2010.

(56) References Cited

U.S. PATENT DOCUMENTS 2,871,490 A * 2/1959 Balonick ..... A61G 7/0515 5/430
3,032,781 A 5/1962 Constanti
3,045,259 A 7/1962 Mayer
3,290,701 A 12/1966 Luff
3,624,847 A 12/1971 Murcott et al.
4,103,376 A * 8/1978 Benoit ..... A61G 7/0507 5/100
4,370,765 A * 2/1983 Webber ..... A47C 21/08 5/427
4,724,559 A 2/1988 Bly et al.
4,827,545 A * 5/1989 Arp ..... A47C 21/08 5/424
5,038,430 A 8/1991 Bly
5,596,776 A 1/1997 Huang
5,671,490 A 9/1997 Wu
6,216,296 B1 4/2001 Carrasco
6,990,697 B1 * 1/2006 Clute ..... A47C 21/08 5/425
7,013,508 B2 3/2006 Wu
7,028,353 B2 4/2006 Waldman et al.
7,103,928 B1 9/2006 Childs
7,302,720 B2 12/2007 Flannery et al.
7,373,679 B2 5/2008 Miller
7,640,606 B2 1/2010 Flannery et al.
7,913,333 B2 3/2011 Flannery et al.
8,458,831 B2 6/2013 Flannery et al.
8,555,436 B2 10/2013 Flannery et al.
8,683,629 B2 * 4/2014 Clenet ..... A61G 7/015 5/613
8,726,433 B1 5/2014 Flannery et al.
8,966,682 B1 3/2015 Flannery et al.
2003/0024047 A1 * 2/2003 Wu ..... A61G 7/0507 5/430
2004/0250347 A1 * 12/2004 Brewin ..... A47C 21/08 5/426
2006/0162075 A1 7/2006 Waldman et al.
2011/0179569 A1 7/2011 Hayano et al.
2012/0084915 A1 4/2012 Flannery et al.
2012/0084916 A1 4/2012 Flannery et al.

FOREIGN PATENT DOCUMENTS

GB 2225716 A * 6/1990
GB 2350786 A 12/2000

* cited by examiner 10
12
18
20
26
28
30
32
34
36
38
40
54
74
76

BED RAIL HAVING CENTER TUBES CONNECTED TO EACH OTHER

This application is a divisional of U.S. patent application Ser. No. 14/880,226 filed Oct. 10, 2015 and claims the benefit thereof under 35 U.S.C. 120, which application is a divisional of U.S. patent application Ser. No. 14/635,954 filed Mar. 2, 2015 (now U.S. Pat. No. 9,155,400 issued Oct. 13, 2015) and claims the benefit thereof under 35 U.S.C. 120, which application is a continuation of U.S. patent application Ser. No. 14/052,740 filed Oct. 12, 2013 (now U.S. Pat. No. 8,966,682 issued Mar. 3, 2015) and claims the benefit thereof under 35 U.S.C. 120, which application is a continuation of U.S. patent application Ser. No. 13/269,591 filed Oct. 8, 2011 (now U.S. Pat. No. 8,555,436 issued Oct. 15, 2013) and claims the benefit thereof under 35 U.S.C. 120, which application claims the benefit under 35 U.S.C. 119(e) of the following U.S. provisional patent application numbers: 1) 61/391,583 filed Oct. 8, 2010, 2) 61/406,995 filed Oct. 26, 2010, 3) 61/407,013 filed Oct. 26, 2010; 4) 61/407,902 filed Oct. 28, 2010; and 5) 61/415,808 filed Nov. 19, 2010, all of which nonprovisional and provisional patent applications are hereby incorporated by reference in their entireties into this application.

FIELD OF THE INVENTION

The present invention relates generally to bed rail that prevents a child from falling out of bed, particularly to a bed rail having horizontal legs inserted between a mattress and box spring, and specifically to a bed rail having such legs and a horizontally expandable guard rail swingably attached to the legs and extending vertically to beyond the sleeping surface.

BACKGROUND OF THE INVENTION

Consumer products are manufactured, shipped, sold to consumers, assembled, and then installed. The assembly and installation steps are often performed by the end user. The end user is, of course, likely not a mechanical engineer. Instead, the end user is likely a layman. The end user may not take the time to read the assembly and installation steps. The instructions may not be in the first language of the end user. Not surprisingly, the consumer product may be assembled or installed incorrectly.

SUMMARY OF THE INVENTION

A feature of the present invention is a horizontally expandable bed rail.

Another feature of the present invention is the provision in a horizontally expandable bed rail, of a guard rail frame including first and second vertical support members, and upper, lower and intermediate horizontal support members engaged between the first and second vertical support members, and of the upper, lower and intermediate support members sliding in and out in a horizontal direction such that the vertical support members have an extended position where the vertical support members are spaced from each other by a first distance and such that the vertical support members have a drawn in position where the vertical support members are spaced from each other by a second distance that is less than the first distance.

Another feature of the present invention is the provision in a horizontally expandable bed rail, of each of the upper, lower and intermediate horizontal support members including at least three tubes, with the tubes telescoping relative to each other.

Another feature of the present invention is the provision in a horizontally expandable bed rail, of the upper, lower and intermediate horizontal support members including first, second and third tubes, with the first tube confronting the first vertical member, with the second tube confronting the second vertical member, and with the third tube being disposed between the first and second tubes and telescoping relative to the first and second tubes.

Another feature of the present invention is the provision in a horizontally expandable bed rail, of each of the upper, lower and intermediate horizontal support members including a stop that prevents sliding of each horizontal support member when the extended position is obtained by such sliding.

Another feature of the present invention is the provision a horizontally expandable bed rail, of each of the vertical support members being integral and/or one-piece such that a height of said vertical support member is constant.

Another feature of the present invention is the provision in a horizontally expandable bed rail, of a junction between a vertical support member and a horizontal support member, of the junction confronting a first side of the bed, of an anchor confronting a second side of the bed opposite of the first side, of a flexible member between the junction and the anchor such that, when tension is applied to the flexible member, the junction and the anchor hug the bed therebetween, of the anchor including an anchor lock to lock the flexible member to the anchor, and of the junction including a junction lock to lock the flexible member to the junction.

Another feature of the present invention is the provision in a horizontally expandable bed rail, of the anchor lock being releasable to release tension on the flexible member from the anchor.

Another feature of the present invention is the provision in a horizontally expandable bed rail, of the junction lock being a tension junction lock that unlocks when tension on the flexible member is released and that locks when tension is placed on the flexible member.

Another feature of the present invention is the provision in a bed rail, of a guard frame having a pair of end frame portions and a removable central frame portion, and of the removable central frame portion having upper, lower and intermediate horizontally extending support members that are engaged to each other when the central frame portion is engaged to the end frame portion and when the central frame portion is not engaged to the end frame portions such that engagement of the upper, lower and intermediate horizontally extending support members of the central frame portion to each other is independent of the engagement of the central frame portion to the end frame portions.

Another feature of the present invention is the provision in a bed rail, of a guard frame having a pair of end frame portions and a central frame portion engaged therebetween with a set of elastic cord portions, with the elastic cord portions extending between upper horizontally extending support members of the end frame portions and the central frame portion, with the elastic cord portions extending between lower horizontally extending support members of the end frame portions and the central frame portion, and with the elastic cord portions extending between intermediate horizontally extending support members of the end frame portions and the central frame portion.

Another feature of the present invention is the provision in a bed rail, of a guard frame having a pair of end frame portions, with each of the end frame portions having upper, lower and intermediate horizontally extending support members, and with each of the support members of one end frame portion engaging a support member of the other end frame portion with a lockable hinge.

Another feature of the present invention is the provision in a bed rail, of a guard frame having a pair of end frame portions engagable to each other, of each of the end frame portions having a vertically extending support member and upper, lower and intermediate horizontally extending support members, and of respective upper, lower and intermediate hinges connecting the vertically extending support member with the upper, lower and intermediate horizontally extending support members.

An advantage of the present invention is that assembly of a bed rail by an end user is minimized.

Another advantage of the present invention is that steps for installing the bed rail on a bed are minimized.

DESCRIPTION

Figures 1A, 1B, 1C, 1D, 1E:
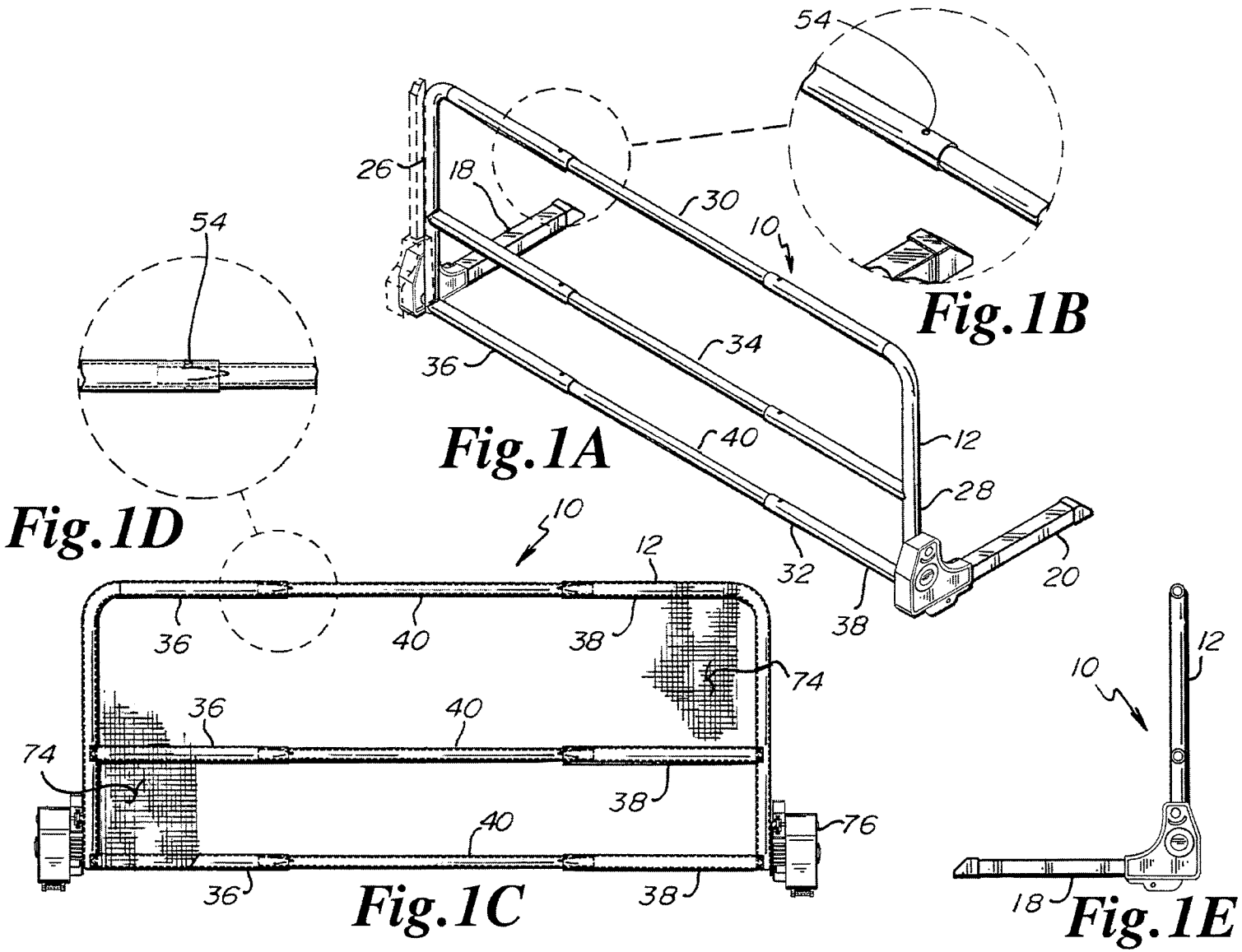
FIG. 1A is a perspective view of the present horizontally expandable bed rail in an extended position.
FIG. 1B is a detail view of a portion of FIG. 1A showing a spring button that will automatically lock into place when the bed rail is fully extended.
FIG. 1C is a front plan view of the horizontally expandable bed rail of FIG. 1A in an extended position.
FIG. 1D is a detail view of a portion of FIG. 1C showing a spring button located inside of a middle tube, where the spring button engages the outer tube when the bed rail is fully extended.
FIG. 1E is a side plan view of the horizontally expandable bed rail of FIG. 1A.
Figure 2A:
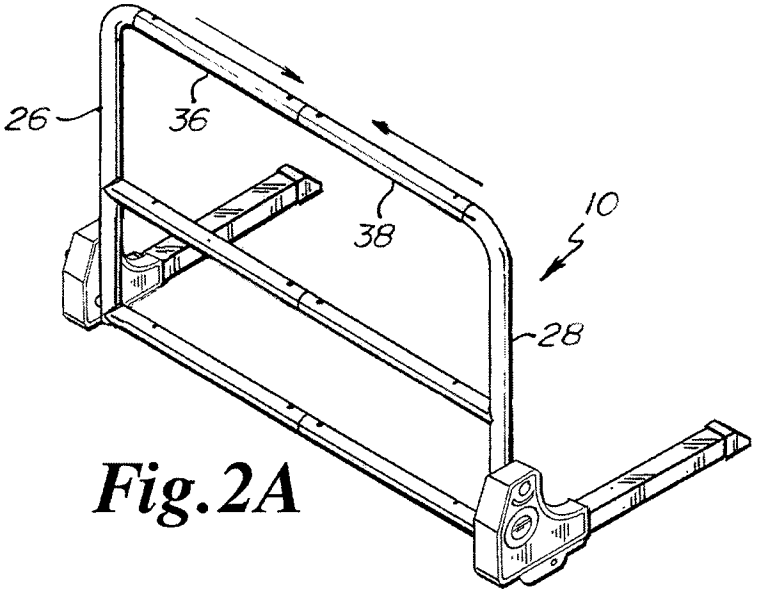
FIG. 2A is a perspective view of the horizontally expandable bed rail of FIG. 1A in a drawn in or collapsed position.
Figure 2D:
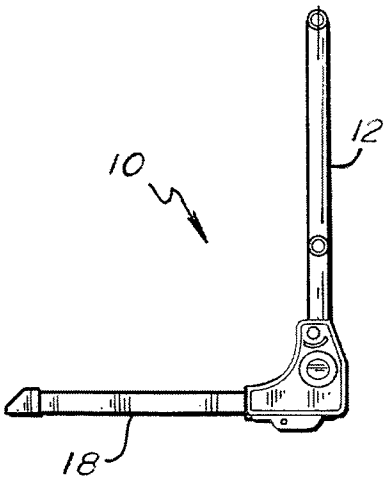
FIG. 2D is a side plan view of the horizontally expandable bed rail of FIG. 2A.
Figure 2B:
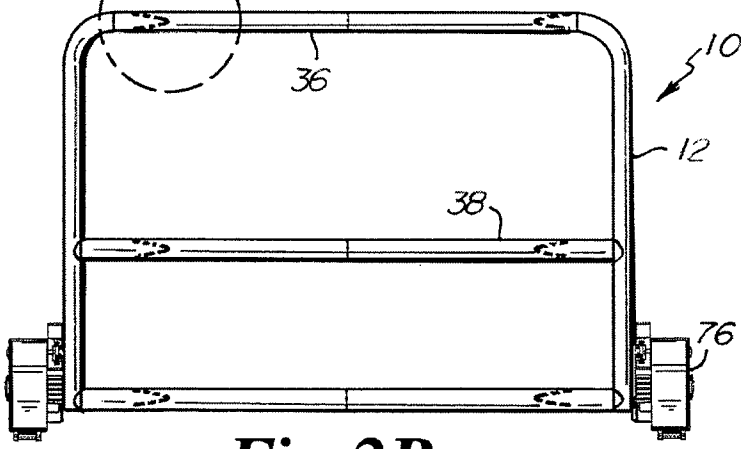
FIG. 2B is a front plan view of the horizontally expandable bed rail of FIG. 1A in the drawn in or collapsed position.
Figure 2C:
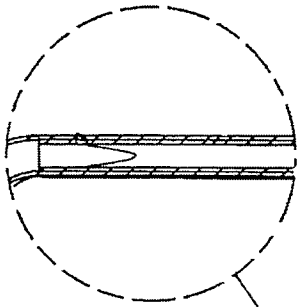
FIG. 2C is a detail view of a portion of the horizontally expandable bed rail of FIG. 2B and shows how the middle tube slides into the outer tube.

The Embodiment of FIGS. 1A, 1B, 1C, 1D, 1E, 2A, 2B, 2C, 2D, 3, 4, 5, 6, 7, 8A, 8B, 9A and 9B As shown in FIG. 1A, the present horizontally expandable bed rail is indicated by reference numeral 10. Horizontally expandable bed rail 10 includes a guard rail frame 12 for confronting a first side 14 of a bed 16 (shown in FIG. 9A) for preventing a child from rolling off the bed 16, and first and second legs 18, 20 engaged to the guard rail frame 12, with the first and second legs 18, 20 being disposed horizontally to extend between a mattress 22 and box spring 24 of the bed 16.

The guard rail frame 12 includes first and second vertical support members 26, 28 and further includes upper, lower and intermediate horizontal support members 30, 32, 34 engaged between the first and second vertical support members 26, 28. Each of the upper, lower and intermediate support members 30, 32, 34 relatively slides in and out, or expands or retracts, in a horizontal direction such that the vertical support members have an extended position where the vertical support members 26, 28 are spaced from each other by a first distance and such that the vertical support members 26, 28 have a drawn in position where the vertical support members 26, 28 are spaced from each other by a second distance that is less than the first distance.

Each of the upper, lower and intermediate horizontal support members 30, 32, 34 is tubular. Each of the vertical support members 26, 28 may be tubular.

Each of the upper, lower and intermediate horizontal support members 30, 32, 34 is telescoping. Each of the vertical support members 26, 28 is one piece and/or integral such that a height (or length) of each of the vertical support members 26, 28 is constant such that the height (or length) of the vertical support member preferably cannot be adjusted (increased or decreased) by the end user. However, if desired, the vertical support members 26, 28 can be telescoping so as to, for example, adjust the height of the intermediate member 34 to be in or close to the plane of the sleeping surface 68 of the mattress 22.

Each of the upper, lower and intermediate horizontal support members 30, 32, 34 includes at least two tubes, with the tubes telescoping relative to each other. More preferably, each of the upper, lower and intermediate horizontal support members 30, 32, 34 includes at least three tubes 36, 38, 40, with the tubes 36, 38, 40 telescoping relative to each other.

Figure 5:
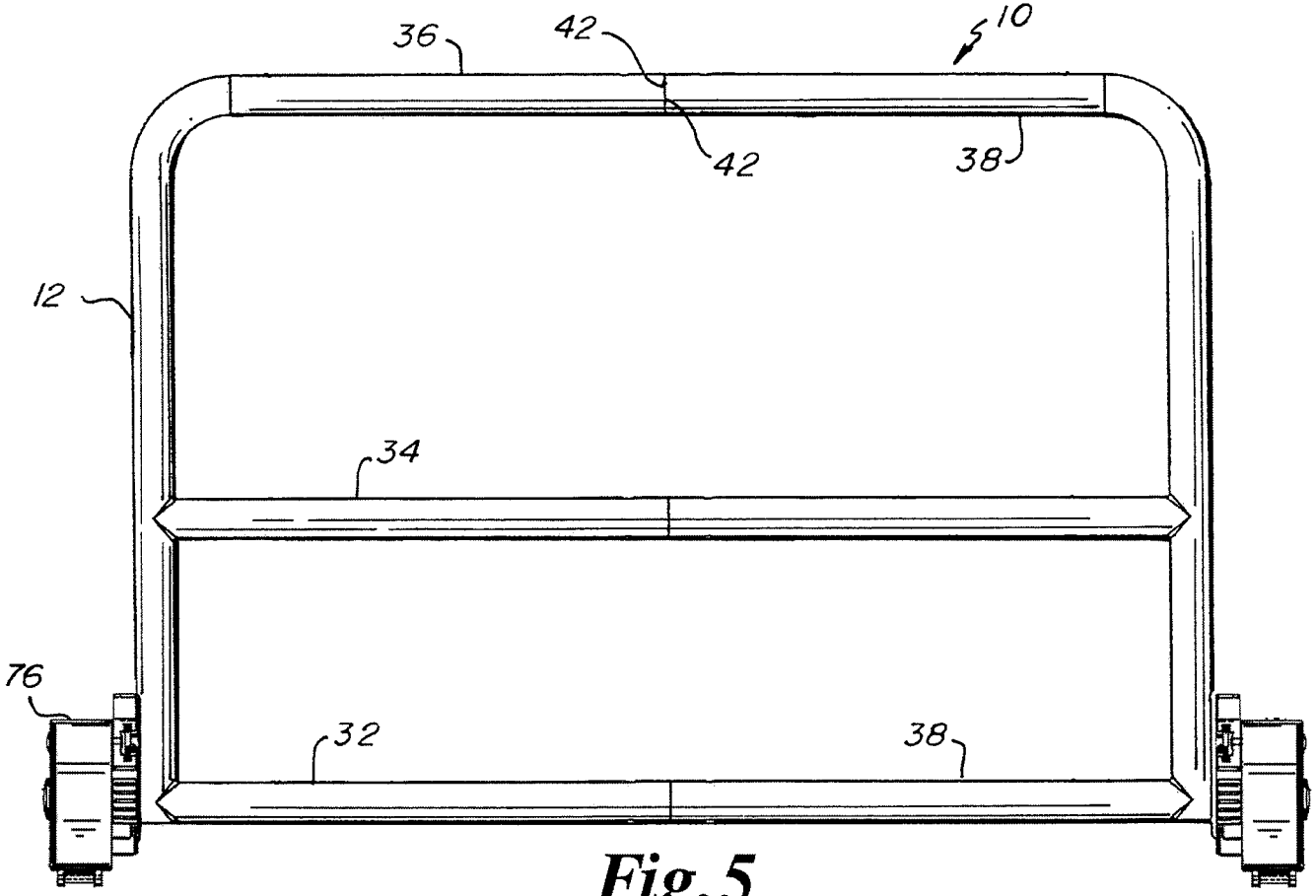
FIG. 5 is a front plan view of the horizontally expandable bed rail of FIG. 1A in the drawn in or collapsed position.
Figure 6:
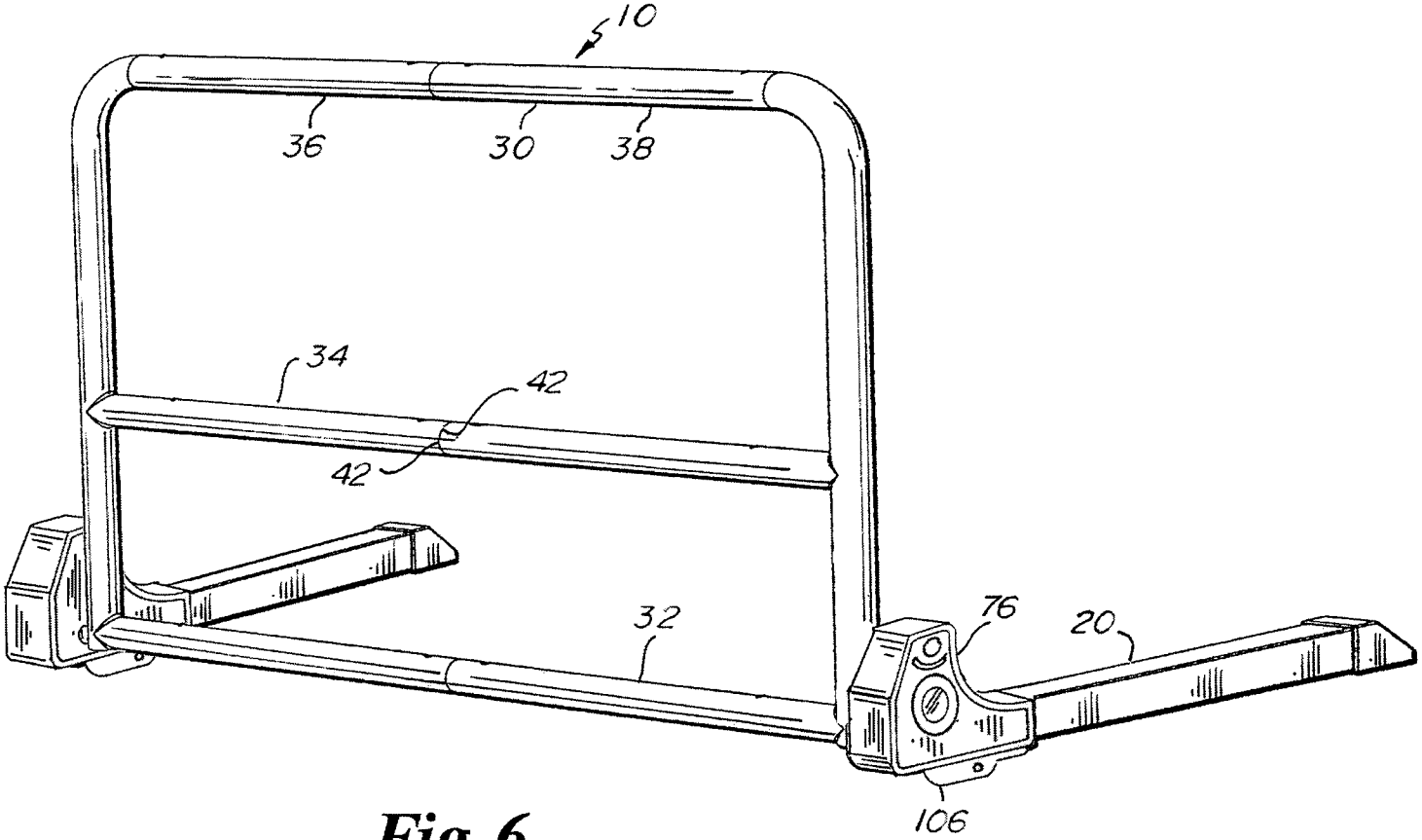
FIG. 6 is a perspective view of the horizontally expandable bed rail of FIG. 1A in the drawn in or collapsed position.
Figure 7:
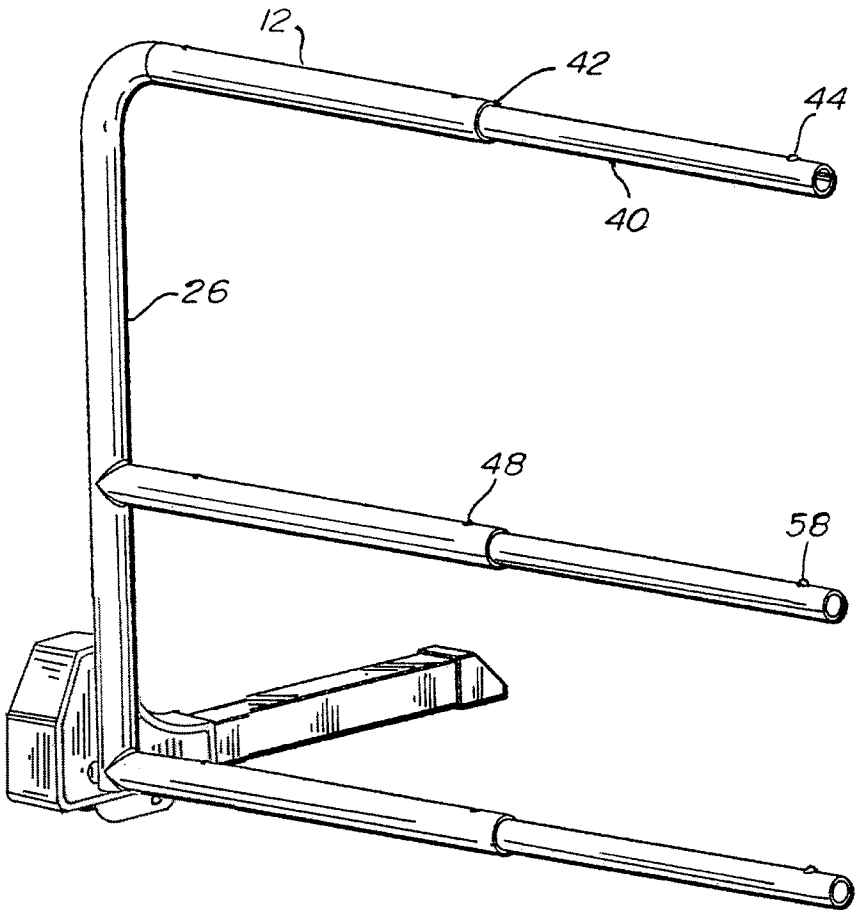
FIG. 7 is a perspective partial view of a portion of the horizontally expandable bed rail of FIG. 1A and shows the middle tubes of each of the upper, lower and intermediate horizontal support members disengaged from their respective end tubes, and further shows the spring biased pin or spring button at an end portion of the middle tubes.

Each of the upper, lower and intermediate horizontal support members 30, 32, 24 includes first, second and third tubes 36, 38, 40, with the first tube 36 confronting the first vertical member 26, with the second tube 38 confronting the second vertical member 28, and with the third tube 40 being disposed between the first and second tubes 36, 38 and telescoping relative to the first and second tubes 36, 38. The third tube 40 (or middle tube 40) slides into each of the first and second tubes 36, 38. The first and second tubes 36, 38 have inner ends 42, with the inner ends 42 confronting each other in the drawn in or retracted position, as shown in FIG. 5. Each of first and second tubes 36, 38 have inner ends 42, with the inner ends 42 making contact with each other in the drawn in position, as shown in FIG. 5.

Each of the upper, lower and intermediate horizontal support members 30, 32, 34 includes at least one stop 44 that prevents sliding of tubes 36, 40 relative to each other, or that prevents sliding of tubes 38, 40 relative to each other, when the drawn in position is obtained by the sliding.

At least two tubes such as tubes 36 and 40 (or tubes 38, 40) include (or share) the stop 44 that prevents sliding of two cooperating tubes 36, 40 (or 38, 40) when the drawn in position is obtained by such sliding. The stop 44 includes a spring biased pin 46 disposed in the tubes 36, 30 (or 38, 40) and engaging a hole 48 formed in each of the at least two tubes 36, 40 (or 38, 40). When the two holes 48 are aligned the pin 46 snaps into and through the holes 48. Pin 46 is cylindrical in the embodiment of FIG. 8B and includes first and second upright sides 50, 52 that extend between a top end 54 and a bottom end 56 of the pin 46 such that, when the pin 46 is fully engaged in and through holes 48, tubes 36 and 40 (or 38 and 40) cannot slide inwardly relative to each other and cannot slide outwardly relative to each other until the top end 54 is depressed below the inner diametrical surface of tube 36 (or 38).

Figure 8A:
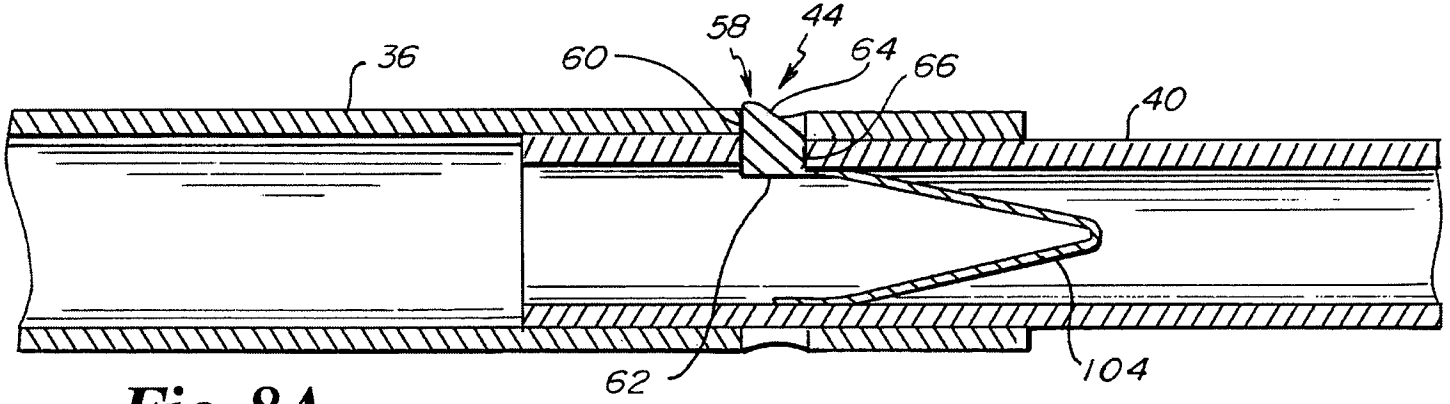
FIG. 8A is a section detail view of any of the upper, lower or intermediate horizontal support members, with middle and end tubes being interlocked by a stop or spring button or spring biased pin of a first embodiment.
Figure 8B:
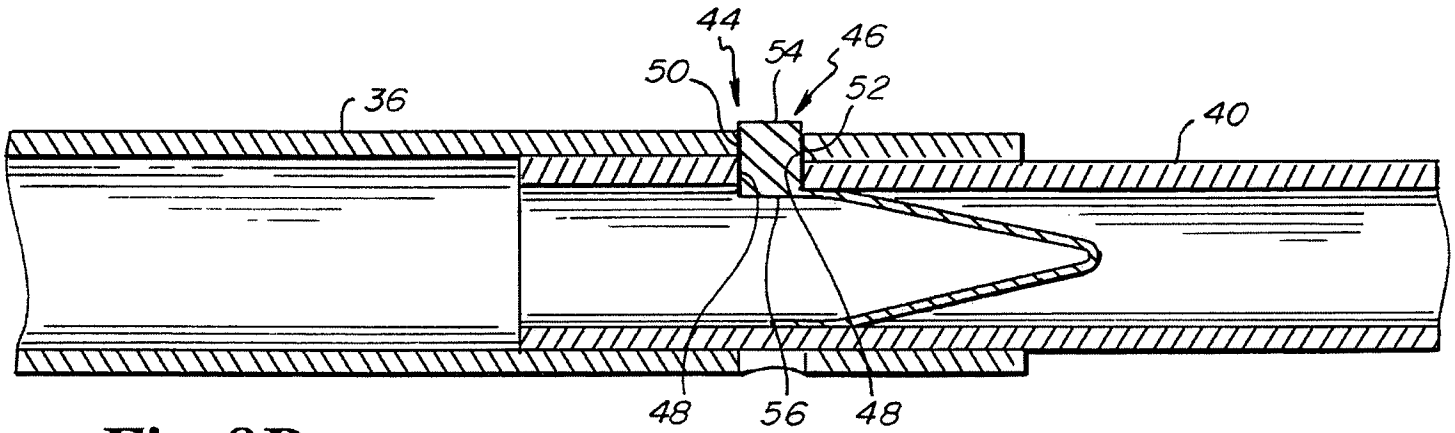
FIG. 8B is a section detail view of any of the upper, lower or intermediate horizontal support members, with middle and end tubes being interlocked by a stop or spring button or spring biased pin of a second embodiment.

In the embodiment of FIG. 8A, pin 58 includes a full upright side 60 that has a height greater than the total thickness of tubes 36 and 40 (or 38 and 40) just like the upright sides 50, 52. Pin 58 further includes a bottom end 62, an inclined top end 64, and an upright shortened side 66. Pin 58 functions just like pin 46, except shortened side 66 makes contact with only a portion of the thickness of outer tube 36 (or 38) such that pin 58 does not need to be depressed as fully as pin 46 to permit tubes 36, 40 (or 38, 40) to slide relative to each other.

It should be noted that the cant of inclined top end 64 and the upright side 60 is a structure that may increase the effort required to slide tubes 36 and 40 toward each other because button or pin 58 must be relatively deeply depressed (past the inner diameter of tube 36) until tubes 36 and 40 can slide toward each other. The effort required to slide the tubes 36 and 40 away from each other is decreased because once the pin or button 58 is slightly depressed, the edge of the opening for pin or button 58 will begin to bring pressure to bear upon the cant of inclined top end 64 and this pressure itself will automatically push pin or button 58 further into tube 36.

It should be noted that the cant of inclined top end 64 may be reversed. If reversed from the structure shown in FIG. 8A, such reverse structure is a structure that may increase the effort required to slide tubes 36 and 40 away from each other because button or pin 58 must be relatively deeply depressed (past the inner diameter of tube 36) until tubes 36 and 40 can slide away from each other. With this reversed structure, the effort required to slide the tubes 36 and 40 toward each other is decreased because once the pin or button 58 is slightly depressed, the edge of the opening for pin or button 58 will begin to bring pressure to bear upon the cant of inclined top end 64 and this pressure itself will automatically push pin or button 58 further into tube 36.

It should be noted that spring biased button 44 includes the pin 46 (or 58) and an integral V-shaped resiliently biased spring 104 that is engaged to the inner diametrical surface of middle tube 40.

Each of the upper, lower and intermediate horizontal support members 30, 32, 34 includes stop 44 that prevents sliding of the tubes 36, 38 and 40 when the extended position is obtained by the sliding.

Upper horizontal support member 30 lies above a plane of the sleeping surface 68 of the bed 16. The intermediate horizontal support member 34 lies in one of a) the plane of the sleeping surface 68 of the bed 16 and b) a plane confronting the plane of the sleeping surface 68 of the bed 16.

The guard rail frame 12 swings relative to the first and second legs 18, 20 such that the upper horizontal support member 30 swings between a first position above the plane of a sleeping surface of the bed and a second position below the plane of a sleeping surface 68 of the bed 16. Each of such first and second positions lies in a vertical plane. Each of the first and second legs 18, 20 can also swing into the plane of the guard rail frame 12, as shown in phantom in FIG. 1A, such as for storage, when the bed rail 10 is retracted in by the telescoping legs 30, 32, 34 to its retracted form. Each of the proximal ends of the legs 18, 20 are engaged in a junction 76 which in turn is pivotally engaged to the guard rail frame 12. As to junction 76, U.S. Provisional Patent Application No. 61/406,995 filed Oct. 26, 2010 and U.S. patent application Ser. No. 13/253,871 filed Oct. 5, 2011 are hereby incorporated by reference in their entireties. With such a junction 76, a proximal end of a flexible member 78 is operatively engaged to a buckle 106 (shown in FIG. 6) and the distal end of the flexible member 78 is engaged to the counter member or anchor 70 such that, by pulling on the proximal end of flexible member 78 adjacent the first side of the bed 16, the distal end of anchor 70 is pulled tightly against the second side of the bed 16. Junction 76 may alternatively contain the structure shown in FIGS. 10A, 10B and 11.

Figure 9A:
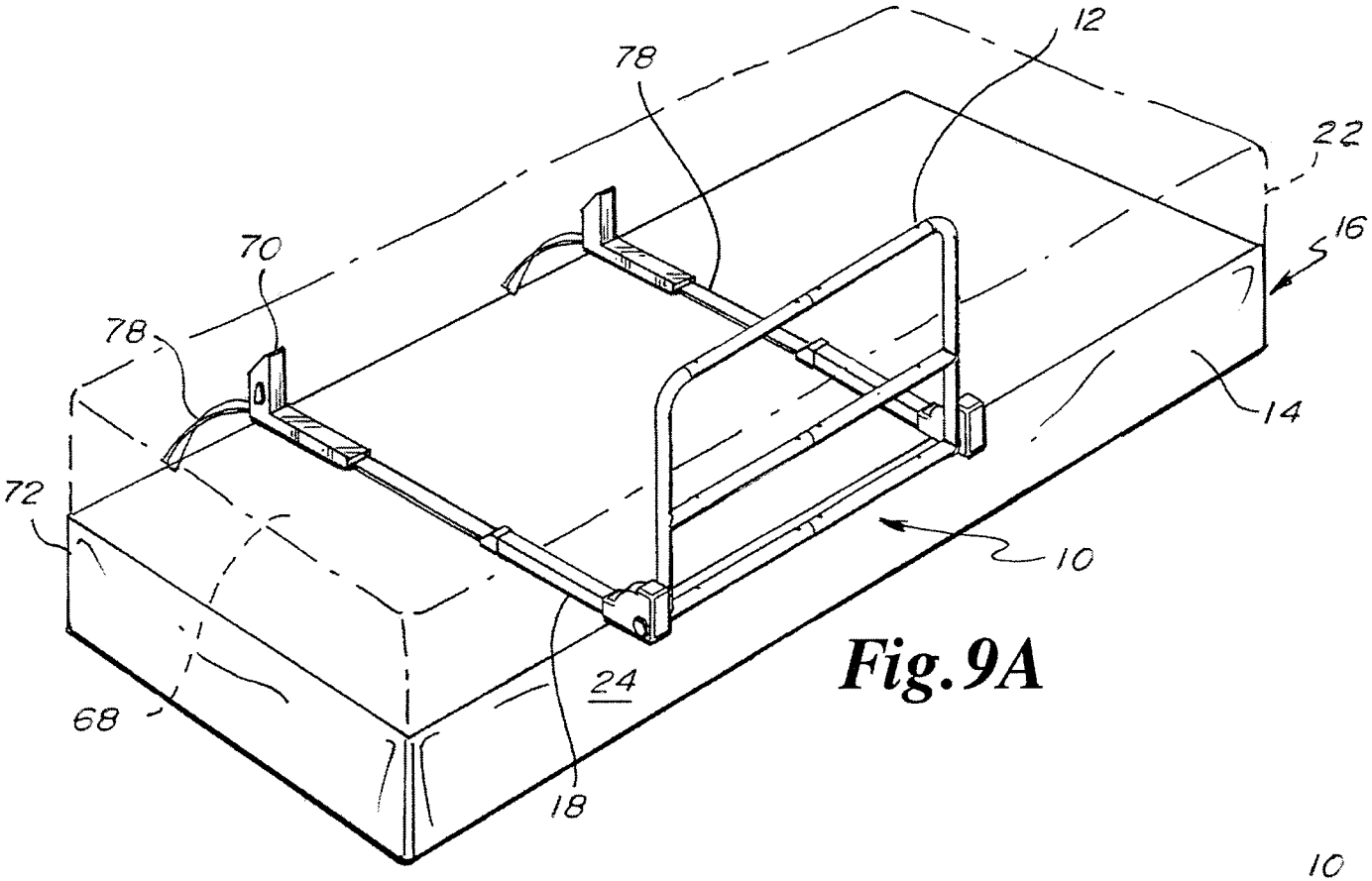
FIG. 9A is a perspective view of the horizontally expandable bed rail of FIG. 1A having a counter member or anchor engaged to the legs of the horizontal expandable bed rail.

The horizontally expandable bed rail 10 further includes a counter member or anchor 70 (as shown in FIG. 9A) engaged to the first and second legs 18, 20, with the guard rail frame 12 confronting a first side 14 of the bed 16, and with the counter member 70 engaging a second side 72 of the bed 16 opposite to the first side 14 of the bed 16 to keep the horizontally expandable bed rail 10 hugging the bed 16. The housing of junction 76 acts a counter member on the first side 14 of the bed 16 such that the bed rail 10 keeps hugging the bed 16 when the guard rail frame 12 is swung down.

The guard rail frame 12 comprises sheeting 74 extending between the first and second vertical support members 26, 28, with the sheeting 74 extending between the upper and intermediate horizontal support members 30, 34, and with the sheeting 74 extending between the intermediate and lower horizontal support members 34, 32.

Each of the vertical support members 26, 28 is integral such that a height of the vertical support member 26 (or 28) is constant. Each of the vertical support members 26, 28 is one-piece such that a height of the vertical support member 26 (or 28) is constant.

In operation, the bed rail 10 is taken out of a box in a stored configuration. In this stored configuration, the ends 42 of tubes 36 and 38 confront (make contact with or are adjacent with one another) or abut (make contact with) each other such that each of the members 30, 32, 34 are in the retracted position. In this retracted position, the button 44 is preferably not engaged in aligned openings. However, if desired, one pair of aligned openings may be formed between tubes 36 and 40 and another pair of aligned openings may be formed between tubes 38 and 40 to keep the members 30, 32, 34 from sliding outward unintentionally when stored. In this stored configuration, the legs 18 and 20 have been swung up to be coplanar with the guard rail frame 12. In this stored configuration, it is preferable that the flexible member or strap 78 has already been engaged to the anchor or counter member 70 and to its respective leg 18 or 20.

After being taken out of the box, the vertical side members 26 and 28 may be pulled apart, whereupon the members 30, 32, 34 expand or telescope outward until the buttons 44 snap into the aligned openings 48, whereupon such expansion stops. Then the legs 18, 20 are swung out of the plane of the guard rail frame 12 to be at generally a right angle, or slightly less than a right angle, relative to the guard rail frame 12. If desired, there may be multiple aligned openings formed between tubes 36 and 40 on the one hand and tubes 38 and 40 on the other hand, such that a distance between vertical side members 26, 28 may be adjusted. Then the bed rail 10 may be engaged to bed 16 by employing the flexible members 78 and anchors 70.

To take down and store the bed rail 10, the operation is reversed. The flexible members 78 and anchors 70 are removed from the bed 16. The legs 18, 20 are swung to be coplanar with the guard rail frame 12. The buttons 44 are depressed and then the side vertical members 26 and 28 are pushed toward each other until the ends 42 confront or abut each other. Then the bed rail 10 may be placed back in its storage box.

Buttons 44 are preferably employed at least twice on each of the horizontal members 30, 32 and 34, where one button 44 acts as a stop between tubes 36 and 40 and where another button 44 acts as a stop between tubes 38 and 40 such that a total of six buttons 44 is preferably employed. However, if desired, buttons 44 may be absent from one of the horizontal members 30, 32, 34 and, if such is the case, it is preferred that the buttons 44 are absent from the intermediate member 34.

Horizontal members 36 are preferably welded to vertical side member 28. Horizontal members 38 are preferably welded to vertical side member 28.

Figure 3:
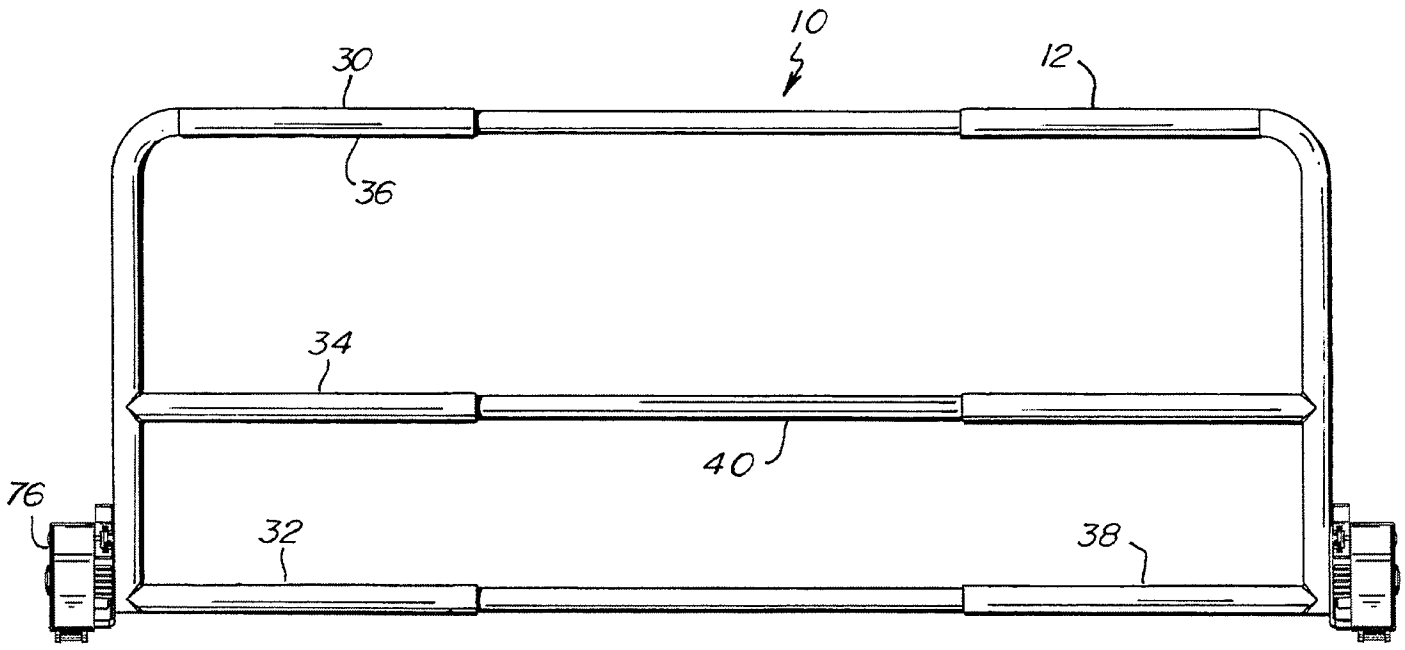
FIG. 3 is a front plan view of the horizontally expandable bed rail of FIG. 1A in the extended position.
Figure 4:
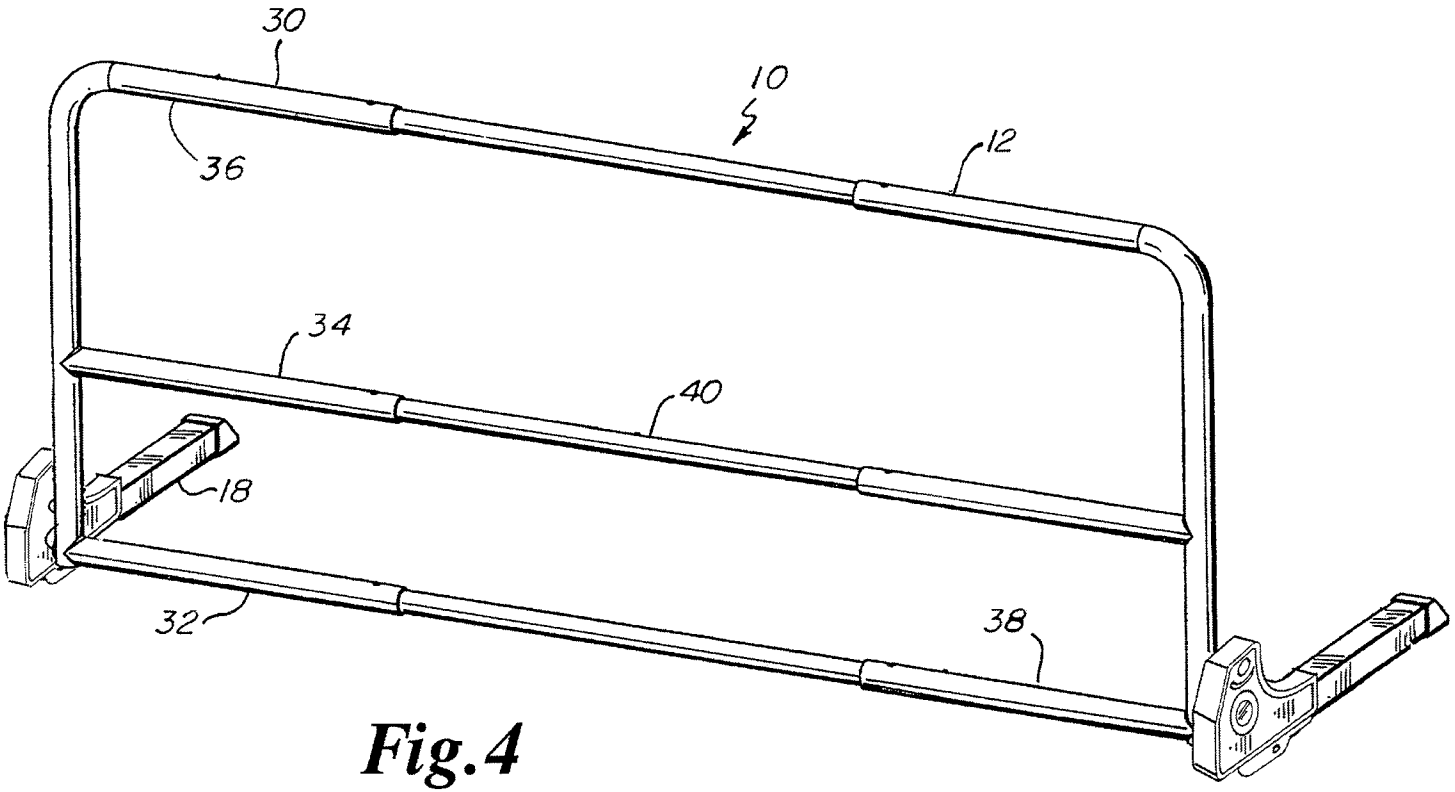
FIG. 4 is a perspective view of the horizontally expandable bed rail of FIG. 1A in the extended position.

In the expanded form, such as in FIGS. 1A, 1C and 3, each of the tubes 36 overlaps for an effective distance in the axial or horizontal direction with its respective tube 40 to provide a lateral or transverse strength to the interconnection between tubes 36 and 40. Likewise, in the expanded form, such as in FIGS. 1A, 1C and 3, each of the tubes 38 overlaps for an effective distance in the axial or horizontal direction with its respective tube 40 to provide a lateral or transverse strength to the interconnection between tubes 36 and 40. Such an effective distance is preferably more than one inch, more preferably more than two inches, even more preferably more than three inches, and yet more preferably more than four inches. Such an effective distance is preferably less than 12 inches.

Each of the members 30, 32 and 34 includes tube 40 that preferably slides within tubes 36 and 38. However, if desired, tubes 36 and 38 can slide inside of tube 40. Or, if desired, tube 36 can slide within tube 40, which in turn can slide within tube 38. Or, if desired, tube 38 can slide within tube 40, which in turn can slide within tube 36.

Bed rail 10 is a bed rail that can be set up by the end user with no installation of parts. The bed rail 10 is preassembled at the factory. As described above, the end user takes the bed rail 10 out of the box, swings the legs 18, 20 down, and pulls part the vertical side members 26, 28, whereupon the buttons 44 snap into place, whereupon the bed rail 10 takes on an operating configuration.

The embodiment of FIGS. 1A, 1B, 1C, 1D, 1E, 2A, 2B, 2C, 2D, 3, 4, 5, 6, 7, 8A, 8B, 9A and 9B includes a guard rail that includes a one-piece left side, a one-piece right side, and a center piece having lower, middle and upper tubes, each of which is engaged to each of the left side and right side.

Figure 10A:
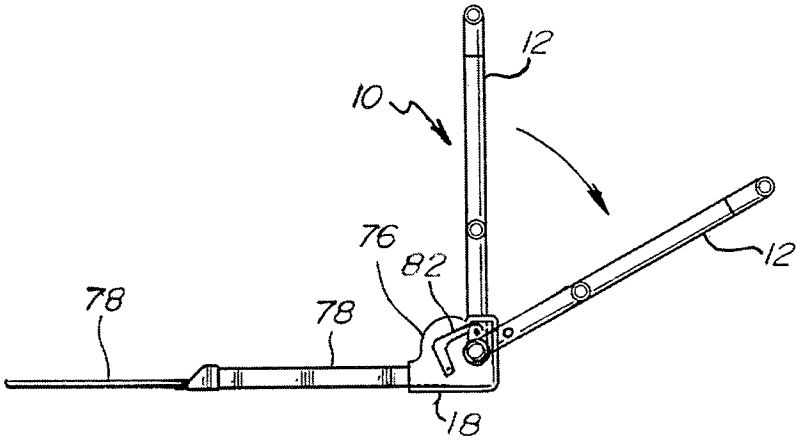
FIG. 10A is a side view of the horizontally expandable bed rail of FIG. 9A.
Figure 10B:
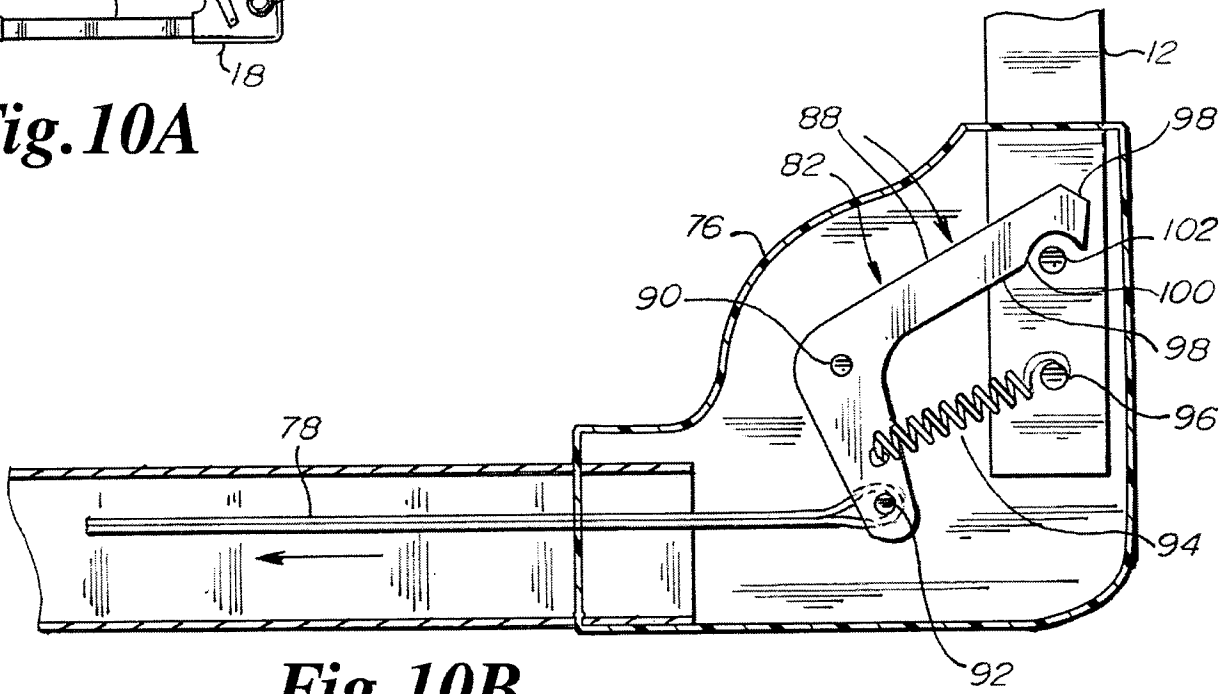
FIG. 10B is a detail view of a portion of the horizontally expandable bed rail of FIG. 10A showing how the guard rail frame is locked in place at the molded body junction between the lower horizontal support member and the guard rail frame when tension is applied to the anchor or counter member and how the guard rail frame may be swung down from the locked position when such tension is released.
Figure 11:
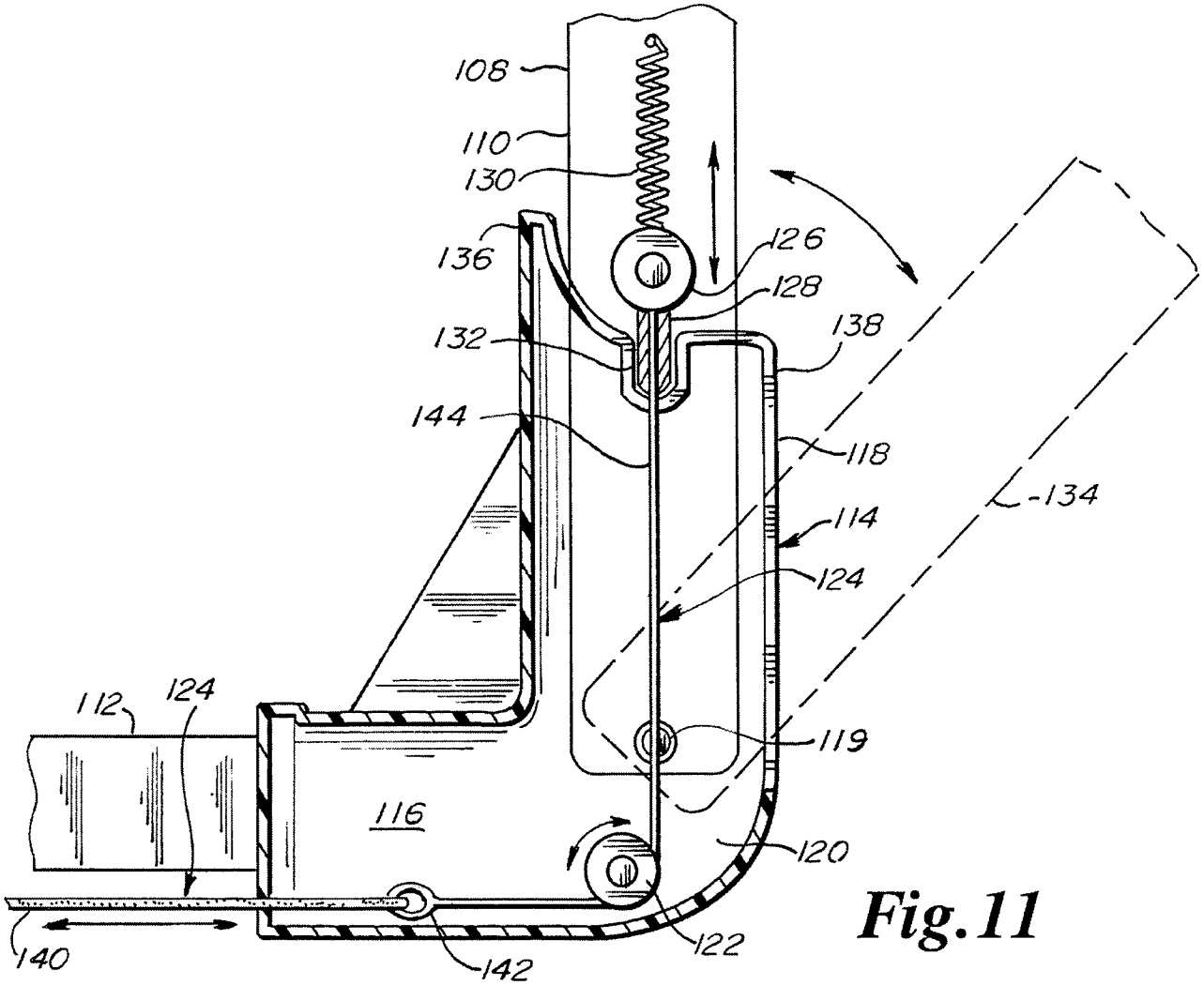
FIG. 11 is a diagrammatic detail view of another embodiment of a guard rail tension lock.

The Embodiment of FIGS. 10A, 10B, and 11

The horizontally expandable bed rail 10 for the bed 16 having the first side 14 and the second side 72 includes the guard rail frame 12 for confronting the side 14 of the bed 16 for preventing a child from rolling off the bed 16, the leg 18 (or 20) engaged to the guard rail frame 12, with the leg 18 (or 20) being disposed horizontally to extend between the mattress 22 and box spring 24 of the bed 16, wherein the guard rail frame 12 includes at least one vertical support member 26 (or 28), wherein the guard rail frame 12 includes at least one horizontal support member 30 (or 32 or 34), a junction 76 between said at least one vertical support member 26 (or 28) and said at least one horizontal support member 30 (or 32 or 34), with the junction 76 confronting the first side 14 of the bed 16, an anchor or counter member 70 confronting the second side 72 of the bed 16, a flexible member 78 such as a flat strap between the junction 76 and the anchor 70 such that, when tension is applied to the flexible member 78, the junction 76 and the anchor 70 hug the bed 16 therebetween, wherein the anchor 70 includes a anchor lock 80 (shown in FIG. 9B) such as a buckle or latch to lock the flexible member 78 to the anchor 70, wherein the junction 76 comprises a junction lock 82 to lock the flexible member 78 to the junction 76. The anchor lock 80 is releasable to release tension on the flexible member 78 from the anchor 70. The junction lock 82 is a tension junction lock 82 that unlocks when tension on the flexible member 78 is released (such as when the anchor lock 80 is unlocked or when the anchor or counter member 70 is released from the second side 72 of the bed 16) and that locks when tension is placed on the flexible member 78.

Figure 9B:
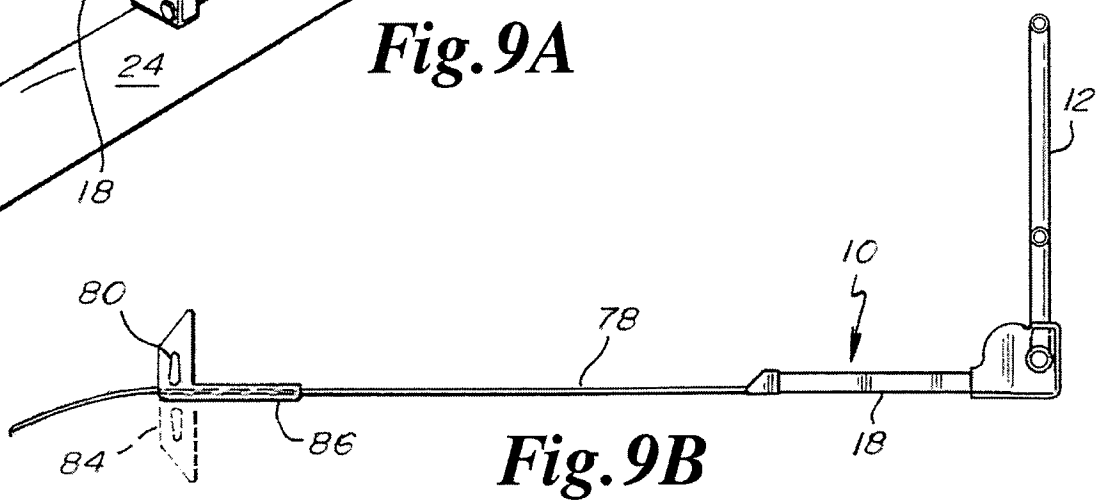
FIG. 9B is a side view of the horizontally expandable bed rail of FIG. 9A.

Counter member 70 may include a lower counter member portion 84 as shown in FIG. 9B such that the anchor or counter member 70 may abut each of the mattress 22 and box spring 24.

Anchor 70 may include a horizontally extending portion 86 that has a slot or hollow portion or tubular portion through which flexible member or strap 78 extends such that flexible member 78 enters a proximal end of the anchor 70 and exits a distal end of the anchor 70. The distal end is accessible to the end user.

Junction lock 82 includes an L-shaped member 88. L-shaped member 88 pivots on a transversely or laterally extending pin 90. Pin 90 is engaged to junction 76, such as to sidewalls of the junction 76. Junction 76 may be a molded plastic body having such sidewalls. L-shaped member 88 includes a lower end portion 92 that engages one end of the flexible member 78. Flexible member 78 extends through one or more hollow or tubular portions of junction 76 and through one or more hollow or tubular portions of leg 18 (or leg 20). Lower end portion 92 is also engaged to a coil spring 94, which in turn is engaged to a pin 96. Pin 96 is engaged to each of junction 76 and guard rail frame 12. Pin 96 is the pivot point about which the guard rail 12 swings. An upper end portion 98 of the L-shaped member 88 includes a cutout 100 or detent portion 100 that engages a pin 102 that is engaged to the guard rail frame 12. When tension on the flexible member or strap 78 is released (such as when anchor lock 80 is unlocked), the coil spring 94 automatically draws in lower end portion 92 of L-shaped member 88, which in turn pivots and draws its upper end portion 98 up and away and out of engagement with pin 102, thereby permitting guard rail portion 12 to be swung downwardly and outwardly from the first side 18 of the bed 16. When tension on the flexible member or strap 78 is present, lower end portion 92 draws the coil spring 94 relatively tightly and maintains the cutout 100 in engagement with pin 102, thereby keeping the guard rail frame 12 in an upright position against the first side 14 of the bed 16.

In operation, starting from the locked and upright position, anchor lock or buckle 80 is released so as to release tension in flexible member 78, whereupon the spring 94 draws the lower end 92 of the L-shaped member 88 toward the pivot pin 96 in the counter clockwise direction from the perspective of FIG. 10B, whereupon the upper end portion 98 also swings counter clockwise from the perspective of FIG. 10B, such that the detent or cutout 100 swings off pin 102, thereby releasing the guard rail frame 12 to swing downwardly and away from the first side of the bed 16, whereupon the guard rail frame 12 swings through the horizontal and then swings further downwardly and back toward the first side of the bed 16, where the user is entitled to relatively easy access to and from the bed 16. To return to the locked and upright position, the steps are reversed. The guard rail frame 12 is swung upwardly through the horizontal and then swung further upwardly to be relatively vertical or swung slightly through the vertical. During this swinging, the upper end portion 98 is kept out of the way of the pin 102, which is swinging upwardly with the guard rail frame 12, by the coil spring 94 maintaining a constant tension on the lower end portion 92 of the L-shaped member 88. Then, while the guard rail frame 12 is relatively vertical, the distal end of the flexible member 78 is pulled to swing the L-shaped member 88 clockwise from the perspective of FIG. 10B to engage the detent 100 with pin 102, whereupon the anchor lock or buckle 80 is operated to lock the flexible member 78 and maintain the tension on lower and upper ends 92, 98 of the L-shaped member 88 and keep the guard rail frame locked in the upright and operating position.

Although anchor lock 80 is preferred, the flexible member 78 and the anchor 80 do not, if desired, have to be related to the junction lock 82. Instead, lower end portion 92 can be engaged in the housing of junction 76 to a laterally extending handle and lock, such that operation of such handle and lock rotates the L-shaped member 88 clockwise and counter clockwise from the perspective of FIG. 10B.

FIG. 11 is a diagrammatic detail view of another embodiment of a guard rail tension lock. FIG. 11 shows a guard frame 108, such as guard frame 12, having a side vertically extending support member 110, such as tube 26. FIG. 11 further shows a leg 112, such as leg 18. Side vertically extending support member 110 and leg 112 are interconnected by a junction or housing 114. Junction 114 is a right angled housing with one receptacle portion 116 fixedly engaging leg 112 and with another receptacle portion 118 pivotally engaging a pivot pin 119 of a tube or side vertically extending support member 110 where the pivot pin 119 extends laterally from the support member 110 into the housing 114. Pivotally engaged to a corner portion 120 of the housing 114 is a pulley 122 having a bight for engaging a general cable 124. At a distal end general cable 124 is engaged to an anchor or counter member such as counter member 70. At a proximal end, general cable 124 is engaged to a locking pin 126. Locking pin 126 extends laterally from support member 110 and away from the support member 110 in the same direction that pivot pin 119 extends away from the support member 110 and toward and into housing 114. Locking pin 126 slides in a slot 128 formed longitudinally in tube or side vertically extending support member 110. Locking pin 126 may have two heads and a shaft between the heads, with the heads being on opposite sides of the support member 110. Engaged to the shaft of pin 126 inside of tube 110 is a coil spring 130 that continuously biases the pin 126 upwardly or away from an open ended slot 132 formed in an upper section of housing portion 118. When the general cable 124 is under the correct amount of tension from the counter member 70 being anchored to the opposite side of the bed correctly, or when the flexible member 78 is locked to the anchor lock 80, the shaft of pin 126 is engaged in slot 132 and, at this time, tube 110 and guard frame 108 cannot swing out of the up position confronting the side of the bed. When tension is released from the anchor or counter member, the coil spring 130 senses such a release of tension and draws the pin 126 upwardly out of the slot 132 and, at this time, the tube and guard frame 108 can swing out of the up position confronting the first side of the bed 16, through a slot formed in the front part of housing 114, and to a position designated by reference number 134. Guard frame 108 can then swing further downwardly through the horizontal and still further downwardly to the first side of the bed 16. It should be noted that if pin 126 is out of the slot 132, the tube 110 and guard frame 108 is prevented from swinging backwardly by an extension 136 of the housing 114 that is of greater height than a section 138 on a front part of the housing 114. It should be noted that while the shaft of the pin 126 is in slots 128 and 132, the opposing ends or heads of the pin 126 are on the outside of either the housing 114 or tube 110 such that there are a pair of slots 132, with each slot 132 formed on one side of the housing 114, and with each of the slots 132 engaging the shaft of pin 126. Coil spring 130 is engaged at an upper end to an inside portion of tube 110. Coil spring is engaged at a lower end to the shaft of the pin 126, as indicated above.

FIG. 11 shows a cable-actuated-lock bed rail structure 108 that will not stand upright without proper adjustment to anchoring or counter member straps that in turn are engaged to counter members such as counter member 70. Anchoring or counter member straps are attached to the cable 124 that pulls the locking pin 126 down into a locked position. Locking pin 126 is pulled up by a spring 130. It should be noted that general cable 124 can be two or more parts. For example, reference number 140 can designate an anchoring strap 140 engaged via a connection 142 to a specific cable 144 that in turn is engaged to the shaft of the pin 126.

If desired, cable 140 may extend through tubular leg 112.

If desired, housing 116 may not include receptacle portion 118 such that side vertical member 110 of guard frame 108 lies on the outside of the housing 114 instead of inside of the housing 116.

Although anchor lock 80 is preferred for the apparatus of FIG. 11, the flexible member 78 and the anchor lock 80 do not, if desired, have to be related to such apparatus. Instead, cable connection 142 can be engaged in the housing of junction 76 to a laterally extending handle and lock, such that operation of such handle and lock draws pin 126 downwardly into engagement with slots 132, and such that operation of such handle and lock releases pin 126 so as to permit the pin 126 to be drawn upwardly by the coil spring 130.

In operation, starting from a locked and upright position of the guard frame 108, the anchor lock 80 is unlocked, thereby releasing tension on the flexible member or cable 140, whereupon the coil spring 130 draws the shaft of the pin 126 upwardly and out from engagement with slots 132, whereupon the guard frame 108 can be swung away from the first side of the bed 16, through the horizontal, and to a dropped down position against the first side of the bed 16. This permits relatively easy access to the sleeping surface of the bed 16. Then, to place the guard frame 108 back in its locked and upright position, the guard frame 108 is swung upwardly through the horizontal to substantially the vertical position, whereupon the counter member 70 is positioned on the second side of the bed, whereupon the flexible member 78 or cable 140 is pulled through the counter member 70 to draw the shaft of the pin 126 into engagement with slots 132, whereupon the flexible member 78 or cable 140 locked to the anchor lock 80 to lock the guard frame 108 in the upright position.

In the embodiments of FIGS. 10A, 10B and 11, the invention includes a bed rail, whether horizontally expandable or not, for a bed having a first side and a second side, where the bed rail includes a) a guard rail frame for confronting the first side of the bed for preventing a child from rolling off the bed; b) a leg, with the leg being disposed horizontally to extend between a mattress and box spring of the bed; c) wherein the guard rail frame includes at least one vertical support member; d) wherein the guard rail frame includes at least one horizontal support member; e) a junction between the guard rail frame and the leg, with the junction confronting the first side of the bed, with the guard rail frame being swingable relative to the junction and the leg; f) an anchor confronting the second side of the bed; g) a flexible member between the junction and the anchor such that, when tension is applied to the flexible member, the junction and the anchor hug the bed therebetween; h) wherein the anchor includes an anchor lock to lock the flexible member to the anchor; and i) wherein the junction comprises a junction lock to lock the guard rail frame from swinging relative to the leg and junction, with said junction lock being operatively connected to said flexible member, with said junction lock being locked when said tension is applied to the flexible member. The invention further includes the anchor lock being releasable to release tension on the flexible member from the anchor, whereupon the junction lock is unlocked to permit the guard rail frame to swing down. The invention further includes the junction lock being a tension junction lock that unlocks when tension on the flexible member is released and that locks when tension is placed on the flexible member.

Figure 12A:
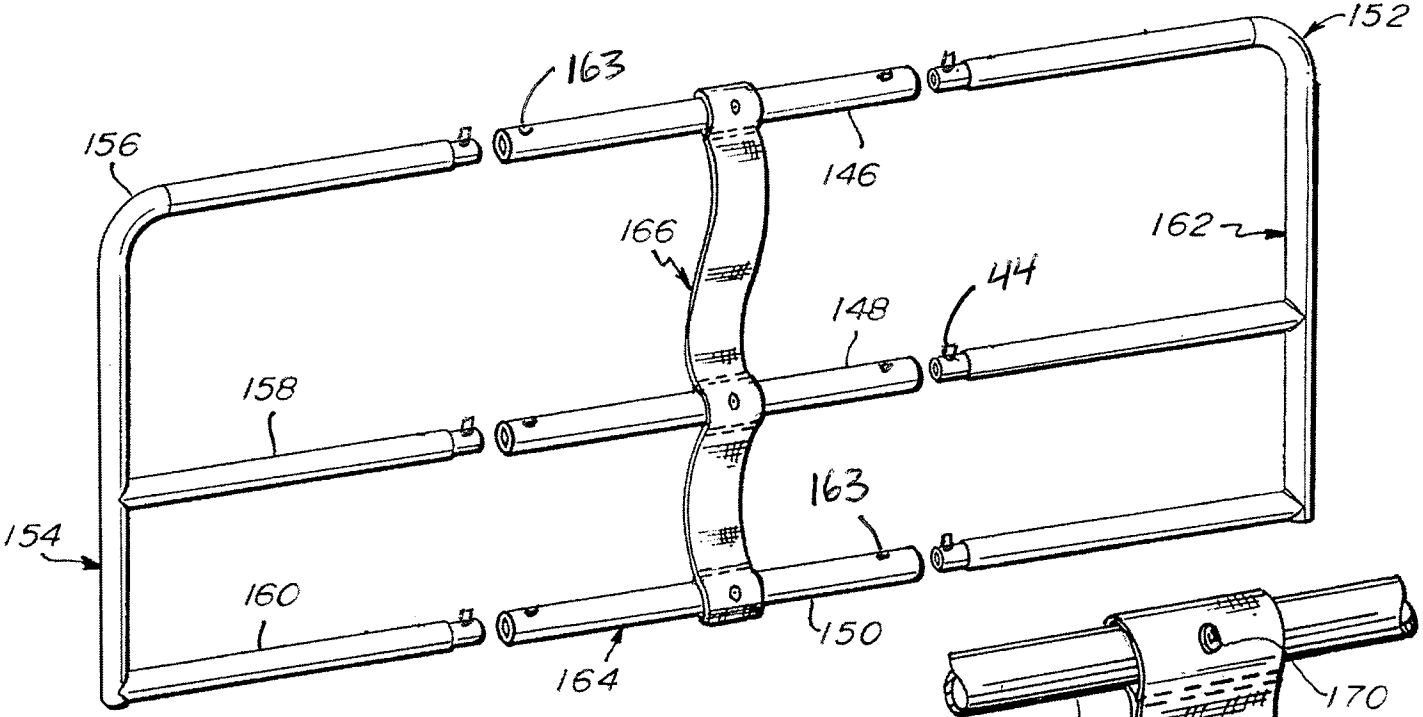
FIG. 12A is a diagrammatic front perspective view of another embodiment of a guard frame having tethered center tubes to minimize or outright prevent improper assembly.
Figure 12B:
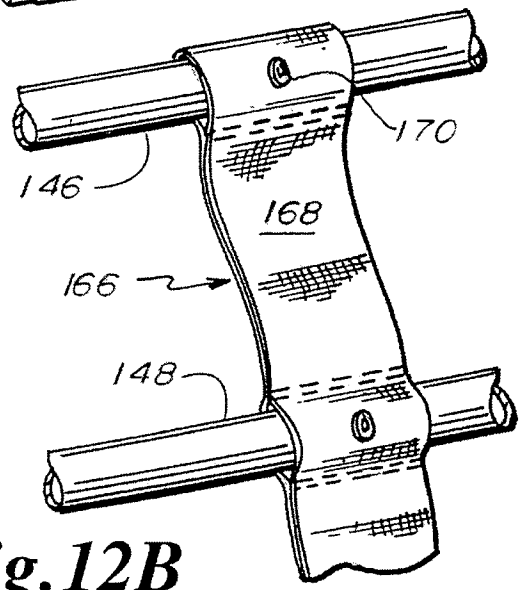
FIG. 12B is a detail front perspective view of a portion of the tethered center tubes of FIG. 12A.

The Embodiment of FIGS. 12A and 12B

FIG. 12A is a diagrammatic front perspective view of another embodiment of a guard frame having tethered center tubes to minimize or outright prevent improper assembly. FIG. 12B is a detail front perspective view of a portion of the tethered center tubes of FIG. 12A. Tethered center tubes 146, 148 and 150 aid in ease of assembly and correct assembly for the consumer. The center tubes 146, 148 and 150 will have to be installed for the bed rail 152 to work correctly. The left third or end 154 of the bed rail 152 cannot be engaged to the right third or end 162 of the bed rail 152 directly. Center tubes 146, 148, 150 must be interconnected between the left and right ends of the bed rail 152.

Guard frame 152 includes a one-piece left side 154 having an L-shaped tube 156, a lower tube 160, and a middle tube 158. Middle tube 158 lies in the plane of the sleeping surface of a bed. L-shaped tube 156 includes a horizontally extending portion and a vertically extending portion. Each of the inner ends of the tubes 158 and 160 is a male end. Also, the inner end of the horizontally extending portion of the L-shaped member 156 is a male end. Guard frame 154 further includes a one-piece right side 162 that is identical to the one-piece left side 154. The male extensions of the three inner ends of the left side 154 may, or may not, include buttons 44. The male extensions of the three inner ends of the right side 162 may, or may not, include buttons 44. Buttons 44 may be of the type shown in FIGS. 8A and 8B. Buttons 44, if used, would engaged button openings 163 formed in the opposite ends of each of the tubes 146, 148, 150 so as to lock the center tubes 146, 148, 150 to each of the left side 154 and right side 162 of bed rail 152. If desired, male extensions may be formed on the outer ends of tubes 146, 148 and 150 and female ends may be formed on the inner ends of members 156, 158 and 160 of the left and right sides 154 and 162. If male extensions are on such outer ends and if female ends are on such inner ends, such male extensions may have buttons 44 and such female ends may have button receiving openings.

A tethered tube package 164 interconnects the left side 154 to the right side 162. The tethered tube package 164 includes center tubes 146, 148 and 150 interconnected by a tether or flexible material 166. Tether 166 is a flexible piece of flat webbing 158 fixed to each of the tubes 146, 148, 150 by rivets 170. Webbing 168 may be double layered. That is webbing 168 may extend on each 180 degree portion of the tubes 146, 148 and 150. For example, on top tube 146, webbing 168 is run over tube 146 and then doubled back on itself and stitched immediately underneath tube 146. Then two band portions of webbing 168 run together down to tube 148, where the two band portions are riveted to tube 148, and where stitching through the webbing 168 is present immediately above and below tube 148. Then two band portions of webbing 168 run down to lower tube 150 where the webbing 168 extends substantially 360 degrees about the lower tube 150. Webbing 168 is stitched back to itself immediately above the lower tube 150. It should be noted that tubes 146, 148 and 150 do not spin in the substantially 360 degree loops formed by webbing 168 since the webbing 168 is riveted twice to each tube 146, 148 and 150. Each of the rivets 170 includes a head on each side of the tubes 146, 148 and 150. Each of the center tubes 146, 148 and 150 have a female end at each of the ends. One advantage of tether 166 is that there are no lost or missing parts.

The type of bed rail in which guard frame 152 is used is not especially limited. For example, guard frame 152 may be substituted for the guard frame shown in the embodiments of FIGS. 1A, 3, 4, 9A, 9B, 10A, 10B, 11, 13, 14, 15, and 16.

Guard frame 152 is easily stored. When stored, right side 156 and left side 162 may lie in the same plane, with the vertical side tubes being opposite one another, and with the three inwardly extending horizontal tubes being disposed between each other or staggered relative to each other such that the inner button ends of the right side 156 lie adjacent to the vertical side tube of the left side 162. When stored, the right side 156 and left side 162 may lie perfectly on top of each other, since the right side 156 is a mirror image of the left side 162. When stored, the tethered tube package 164 is bundled such that the tubes 146, 148 and 150 lie parallel and adjacent to each other.

Each of the male/female couplings in this embodiment overlaps for an effective distance in the axial or horizontal direction to provide a lateral or transverse strength to the interconnection. Such an effective distance is preferably more than one inch, more preferably more than two inches, even more preferably more than three inches, and yet more preferably more than four inches. Such an effective distance is preferably less than 12 inches.

In the embodiments of FIGS. 12A and 12B, the invention includes a bed rail that includes a) a guard rail frame for confronting a side of a bed for preventing a child from rolling off the bed; b) first and second legs engaged to the guard rail frame, with the first and second legs being disposed horizontally to extend between a mattress and box spring of the bed; c) wherein the guard rail frame includes a pair of first and second end frame portions; d) wherein each of the first and second end frame portions includes upper, lower and intermediate horizontal support members; e) a central frame portion, with the central frame portion comprising upper, lower and intermediate horizontal support members; f) wherein the upper, lower and intermediate horizontal support members of the central frame portion are engagable to the upper, lower and intermediate horizontal support members of the first and second end frame portions; and g) wherein the upper, lower and intermediate horizontal support members of the central frame portion are engaged to each other. The invention further includes the upper, lower and intermediate horizontal support members of the central frame portion being engaged to each other with a flexible member, with the flexible member extending from the upper horizontal support member of the central frame portion to the intermediate horizontal support member of the central frame portion to the lower horizontal support member of the central frame portion.

Figures 13A, 13B, 13C:
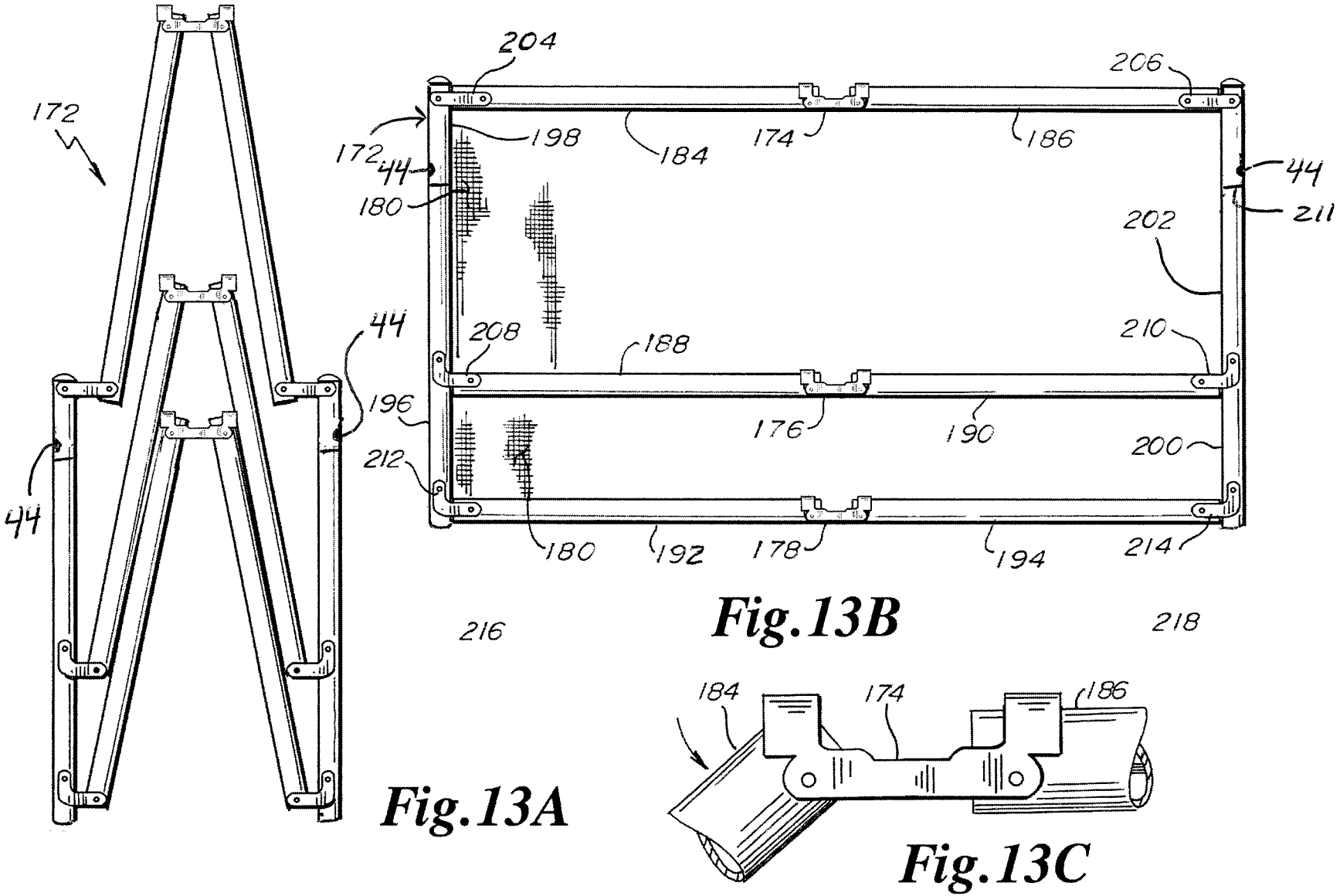
FIG. 13A is a diagrammatic front view of a guard rail frame with a butterfly fold showing the guard rail frame in folded position for storage.
FIG. 13B is a diagrammatic front view of the guard rail frame of FIG. 13A with the butterfly fold showing the guard rail frame in an expanded position for operation.
FIG. 13C is a detail view of the hinge of the guard rail frame of FIGS. 13A and 13B.

The Embodiment of FIGS. 13A, 13B and 13C

FIG. 13A is a diagrammatic front view of a guard rail frame with a butterfly fold showing the guard rail frame in a folded position for storage. FIG. 13B is a diagrammatic front view of the guard rail frame of FIG. 13A with the butterfly fold showing the guard rail frame in an expanded position for operation. FIG. 13C is a detail view of the hinge employed in FIGS. 13A and 13B.

In the butterfly folding guard rail frame 172 of FIGS. 13A and 13B, the entire guard rail frame 172 is completely assembled in one package, and such entire package may include the legs 18, 20 and junction 76 of FIG. 1A, and flexible member 78 and counter member 70, which entire package may be defined as a bed rail or a bed rail apparatus. A consumer merely needs to unfold guard rail frame 172. Hinges 174, 176, and 178 will lock in place when the bed rail 172 is folded out into the expanded and operating position shown in FIG. 13B. A bed rail fabric wall 180 can already be installed in the package so the consumer only needs to unfold the bed rail 172 and install the bed rail 172 on a bed. No extra assembly required.

Each of the hinges 174, 176, and 178 is shaped generally in the form of a saddle having two inverted U-shaped portions. Each of the inverted U-shaped saddle portions engages the upper half surface of an inner end of one of the horizontal support members 184, 186, 188, 190, 192 and 194. Each pair of U-shaped saddle portions is interconnected by a pair of arms that are pivotally affixed to the respective end of the respective horizontal support member. Each of the hinges 174, 176, 178 permits the respective pairs of horizontal support members 184 and 186, 188 and 190, 192 and 194 to pivot into and out of the inverted V-forms shown in FIG. 13A and do not permit the respective pairs of horizontal support members 184 and 186, 188 and 190, 192 and 194 to pivot to a standard V-form from the rectilinear or straight form shown in FIG. 13B.

Guard rail frame 172 includes a) upper tubes 184, 186, middle tubes 188, 190 to be disposed in the plane of the sleeping surface of a bed, lower tubes 192, 194, left side tubes 196, 198, right side tubes 200, 202, releaseably locking center hinges 174, 176 and 178 interconnecting tube pairs 184, 186 and 188, 190 and 192 and 194, respectively, upper straight hinges 204, 206 which may or may not be releaseably locking, middle L-shaped hinges 208, 210 which may or may not be releaseably locking, and lower L-shaped hinges 212, 214 which may or may not be releaseably locking. A bed rail or bed rail apparatus having guard rail frame 172 may further include b) a pair of junctions; c) a pair of legs such as legs 18, 20; and d) anchors 70 engaged to the legs 18, 20 via flexible members or straps 78.

Hinge 204 is connected between tubes 198 and 184. Hinge 206 is connected between tubes 186 and 202. Hinge 208 is connected between tubes 198 and 188. Hinge 210 is connected between tubes 202 and 210. Hinge 212 is connected between tubes 196 and 192. Hinge 214 is connected between tubes 200 and 194.

It should be noted that in the folded up form of FIG. 13A, the folded up form is elongate and not bulky. However, to reduce the length of the folded up form of FIG. 13A, the vertical side members 196 and 202 may each be a two piece upper and lower vertical side member, where the lower member may be a male section and where the upper member may be a female section. Such arrangement is shown by the buttons 44 shown in FIGS. 13A and 13B and by reference number 211 that indicates the junction between the lower piece and upper piece of vertical side member 202. Junction 211 is located at about one-half the height of the guard frame 172 in the folded position shown in FIG. 13A so as to substantially decrease the length of a box in which guard frame 172 is shipped. After or prior to the guard frame 172 being folded, the male and female sections may be removed from each other such that the uppermost horizontal side members 184 and 186 and their respective female vertical side members can be removed from the remaining portion of the guard rail frame 172. Such upper piece that includes members 184 and 186 may then be placed on top of and adjacent to the remaining section, including members 188, 190, 192 and 194, so as to store the guard rail frame 172 in a relatively small box.

To fold the bed rail 172 from the form shown in FIG. 13B to the form shown in FIG. 13A, an upward pressure is applied to each of the center hinges 174, 176 and 178.

The type of bed rail in which guard frame 172 is used is not especially limited. For example, guard frame 172 may be substituted for the guard frame shown in the embodiments of FIGS. 1A, 3, 4, 9A, 9B, 10A, 10B, 11, 13, 14, 15, and 16.

In the embodiments of FIGS. 13A, 13B and 13C, the invention includes a bed rail that includes a) a guard rail frame for confronting a side of a bed for preventing a child from rolling off the bed; b) first and second legs engaged to the guard rail frame, with the first and second legs being disposed horizontally to extend between a mattress and box spring of the bed; c) wherein the guard rail frame includes a pair of first and second end frame portions running vertically; d) upper, lower and intermediate horizontal support members running between the end portions and being pivotally engaged to the end portions; e) wherein each of the upper, lower and intermediate horizontal support members are two pieces, with the two pieces being pivotally engaged to each other. The invention further includes the vertically running end portions being two piece such that upper section of the vertically running end portions and the upper horizontal support member can be removed as one-piece. The invention further includes a hinge providing for the pivotal connection between each of the horizontal support members, with the hinge having interconnected inverted U-shaped portions that prevent a downward pivoting of the two pieces of the horizontal support members.

In the embodiments of FIGS. 13A, 13B and 13C, the invention includes a bed rail that includes a) a guard rail frame for confronting a side of a bed for preventing a child from rolling off the bed; b) first and second legs engaged to the guard rail frame such as through a junction, with the first and second legs being disposed horizontally to extend between a mattress and box spring of the bed; c) wherein the guard rail frame includes a pair of first and second end frame portions; d) wherein the first end frame portions includes a first vertical support member and first upper, lower and intermediate horizontal support members; e) wherein the second end frame portion includes a second vertical support member and second upper, lower and intermediate horizontal support members; e) wherein the first upper horizontal support member is engaged to the second upper horizontal support member with a lockable hinge or a self locking hinge; f) wherein the first lower horizontal support member is engaged to the second lower horizontal support member with a lockable hinge or a self locking hinge; and g) wherein the first intermediate horizontal support member is engaged to the second intermediate horizontal support member with a lockable hinge or a self locking hinge. The invention further includes the first vertical support member being engaged to each of the first upper, lower and intermediate horizontal support members with respective first upper, lower and intermediate hinges, which may or may not be lockable. The invention further includes the second vertical support member being engaged to each of the second upper, lower and intermediate horizontal support members with respective second upper, lower and intermediate hinges, which may or may not be lockable. The invention further includes the self locking hinge having a pair of inverted U-shaped portions interconnected by a rigid arms, where each of the inverted U-shaped portions captures an inner end of respective paired horizontal support members, and where when the inner ends of the paired horizontal support members are under pressure in the downward direction, the inverted U-shaped portions bring pressure to bear on paired the horizontal support members to keep the paired horizontal support members in a substantially straight line.

Figure 14:
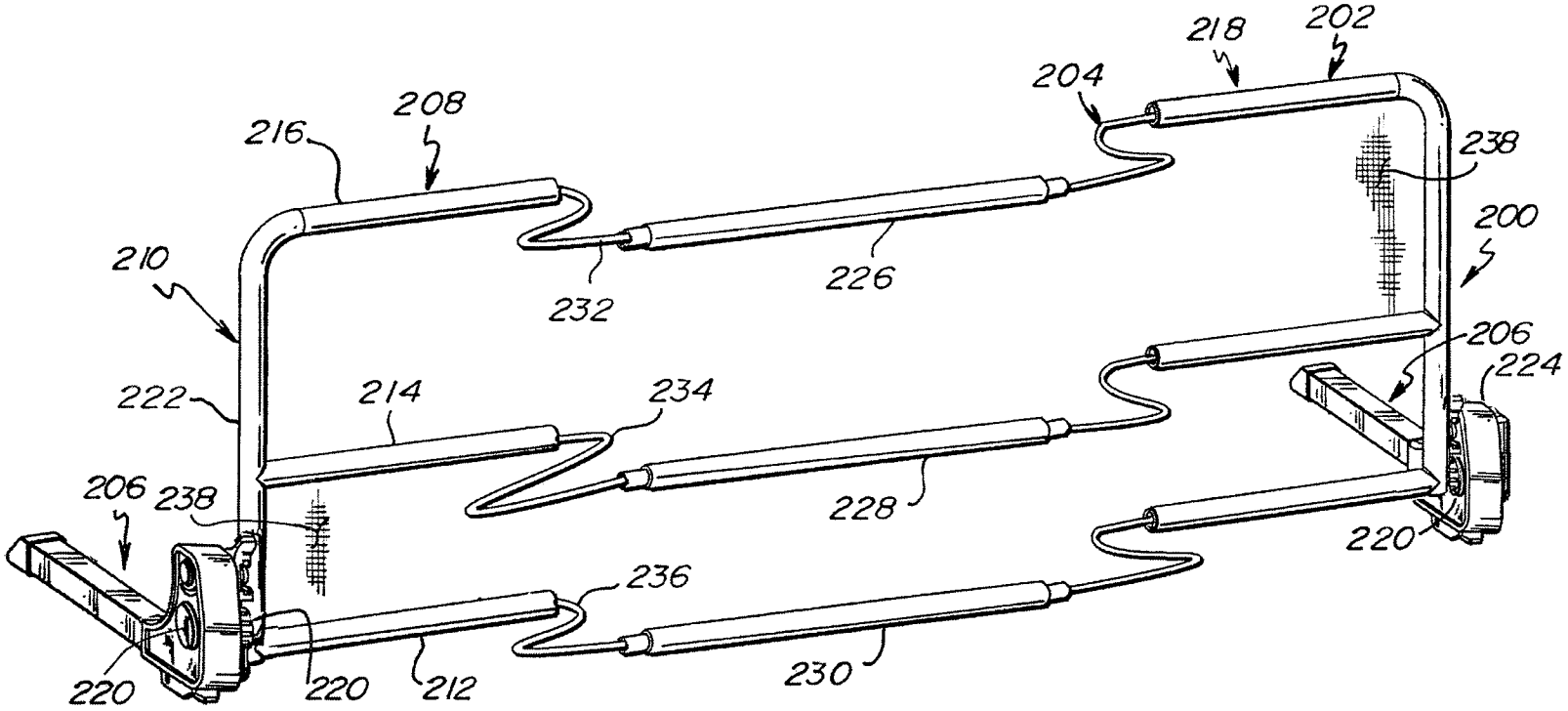
FIG. 14 is a front perspective view of a bed rail where the guard frame is interconnected by elastic cording.

The Embodiment of FIG. 14

FIG. 14 is a front perspective view of a bed rail 200 having a guard frame 202, elastic cording 204 interconnecting portions of the guard frame 202, and a pair of legs 206 pivotally mounted to the guard frame 202.

Guard frame 202 includes a one-piece left side 208 having an L-shaped tube 210, a lower tube 212, and a middle tube 214. Middle tube 214 lies in the plane of the sleeping surface of a bed. L-shaped tube 210 includes a horizontally extending portion and a vertically extending portion. Each of the inner ends of the lower and middle tubes 212 and 214 is a female end. Also, the inner end of the horizontally extending portion 216 of the L-shaped tube 210 is a female end. Guard frame 202 further includes a one-piece right side 218 that is identical to the one-piece left side 208.

Each of the left side and right side guard frame portions 208, 218 have a pivot portion 220 that may be integral and one-piece with lower tube 212. Pivot portion 220 projects outwardly beyond the vertically extending portion 222 of left side L-shaped tube 210 and beyond the vertically extending portion 222 of the L-shaped tube of right side piece 218. Pivot portion 220 serves to mount a pivot junction or housing 224 on a proximal end of leg 206. Junction or housing 224 can lock the guard frame 202 in an up position confronting the side of a bed and projecting beyond the sleeping surface of a bed to prevent a child from rolling off the sleeping surface. Junction or housing 224 can permit the guard frame 202 to swing away from the sleeping surface and swing down to a down position confronting the first side of the bed 16, i.e., to a position about 180 degrees from the up position. As to junction or housing 224, U.S. Provisional Patent Application No. 61/406,995 filed Oct. 26, 2010 and U.S. patent application Ser. No. 13/253,871 filed Oct. 5, 2011 are hereby incorporated by reference in their entireties. With such a junction 224, a proximal end of a flexible member 78 is operatively engaged to a buckle 106 (shown in FIG. 6) mounted on the underside of junction 224, and the distal end of the flexible member 78 is engaged to the counter member or anchor 70 such that, by pulling on the proximal end of flexible member 78 adjacent the first side of the bed 16, the distal end of anchor 70 is pulled tightly against the second side of the bed 16.

Guard frame 202 further has upper, middle and lower center tubes 226, 228, 230. Each of the outer ends of each of the tubes 226, 228, 230 preferably has a male end that mates with the respective female inner end of tubes 216, 214, 212 of the left side and right side portions 208, 218. If desired, such outer ends may be female ends and such inner ends may be male ends. If desired, the male ends of the tubes 226, 228, and 230 may include buttons 44 to engage six respective button receiving openings that may be formed at the inner ends of tubes 212, 214 and 216 of the left and right side portions 208, 218. If the male ends are on the inner ends, such male inner ends may have buttons 44 and the respective outer ends of members 226, 228 and 230 may include button receiving openings.

Elastic cording 204 extends through each of the upper, middle and lower center tubes 226, 228, 230 and further extends into the female openings formed by tubes 216, 214 and 212 of the left side and right side portions 208, 218. Elastic cording 204 is under constant, albeit low, tension such that when, for example, upper central tube 226 is engaged to tube 216, the cording 204 does not droop under the force of gravity and get in the way of the engagement between the male and female ends.

It should be noted that elastic cording 204 can include three separate upper, middle and lower cords 232, 234 and 236. For example, cord 232 may be anchored in each of the upper horizontally extending tubes 216 of left and right side portions 208, 218 and then extend into and through center tube 226. Likewise, middle cord 234 can be anchored in middle tube 214 of the left and right side portions 208, 218, or anchored elsewhere in the portions 208, 218, and then extend into and through middle center tube 228. Also, lower cord 236 can be anchored in lower tube 212 of the left and right side portions 208, 218, or anchored elsewhere in the portions 208, 218, and then extend into and through lower center tube 230.

It should be noted that elastic cording 204 can have essentially two outer column portions and three row portions that are interconnected, where the outer column cord portions extend through the vertical tube portions 222, where the row cord portions extend through tubes or tube portions 212, 214, 216 of the left and right side frame portions 208, 218, and where the row cord portions further extend through the center tubes 226, 228, 230.

It should be noted that the elastic cording 204 can include of three relatively short cord portions, where each of the cord portions, such as cord portions 232, 234 and 236 are anchored in the inner end portions of tubes 212, 214 and 216 of each of the left side and right side portions 208, 218 and then extend into and through the center tubes 226, 228, and 230.

It should be noted that the elastic cording 204 can include three relatively short cord portions, where each of the cord portions, such as cord portions 232, 234, 236 are anchored in the inner end portions of tubes 212, 214 and 216 of each of the left side and right side portions 208, 218, and then the other ends of the cord portions 232, 234, 236 do not extend fully through tubes 226, 228, 230 but instead are anchored inside the outer ends of the tubes 226, 228, 230 such that there are a total of six relatively short cord portions where three of the relatively short cord portions extend from left side portion 208 and the other three relatively short cord portions extend from right side portion 218.

With such elastic cording 204, the chances are minimized that the end user will not misplace any parts or assemble the guard frame 202 incorrectly. Elastic cording 204 can help draw the respective ends of the tubes together for engagement.

With such elastic cording 204, storage space is minimized. In other words, the guard frame 202 in the unassembled form, occupies a minimum of space, since the left side and right side portions 208, 218 can be placed on top of each other or in a substantially planar form where the tubes 212, 214 and 216 are staggered relative to each other or in another fashion where undue stress is not placed on the elastic cording 204.

It should be noted that, if desired, center tubes 226, 228 and 230 may have female outer ends and that respective tubes 216, 214, and 212 may have male ends, or there may be some combination of female/male ends, where left side portion 208 has one type of either male or female ends and where right side portion 218 has the other type of either male or female ends. Or each of upper, middle and lower center tubes 226, 228, 230 can have one type of male and female ends at its left side and the same or other type of male and female ends at its right side. A male/female type of connection is preferred because such adds strength to a multi-piece tube arrangement, i.e., the male portion extends for a substantial longitudinal distance into the female ends.

Each of the male/female couplings in this embodiment overlaps for an effective distance in the axial or horizontal direction to provide a lateral or transverse strength to the interconnection. Such an effective distance is preferably more than one inch, more preferably more than two inches, even more preferably more than three inches, and yet more preferably more than four inches. Such an effective distance is preferably less than 12 inches.

Guard frame 202 includes a flexible wall 238 interconnected among the left and right side portions 208, 218 and the center tubes 226, 228, and 230.

Guard frame 202 can include the counter members 70 engaged to the legs 206 with members 78 such as flexible straps.

In the embodiment of FIG. 14, the invention includes a bed rail that includes a) a guard rail frame for confronting a side of a bed for preventing a child from rolling off the bed; b) first and second legs engaged to the guard rail frame, with the first and second legs being disposed horizontally to extend between a mattress and box spring of the bed; c) wherein the guard rail frame includes a pair of first and second end frame portions; d) wherein each of the first and second end frame portions includes upper, lower and intermediate horizontal support members; e) a central frame portion, with the central frame portion comprising upper, lower and intermediate horizontal support members; and f) wherein the upper, lower and intermediate horizontal support members of the central frame portion are engagable to the upper, lower and intermediate horizontal support members of the first and second end frame portions via an elastic member extending into the upper, lower, and intermediate horizontal support members of the central frame portion and into the upper, lower and intermediate horizontal support members of the first and second end frame portions.

Figures 15A, 15B:
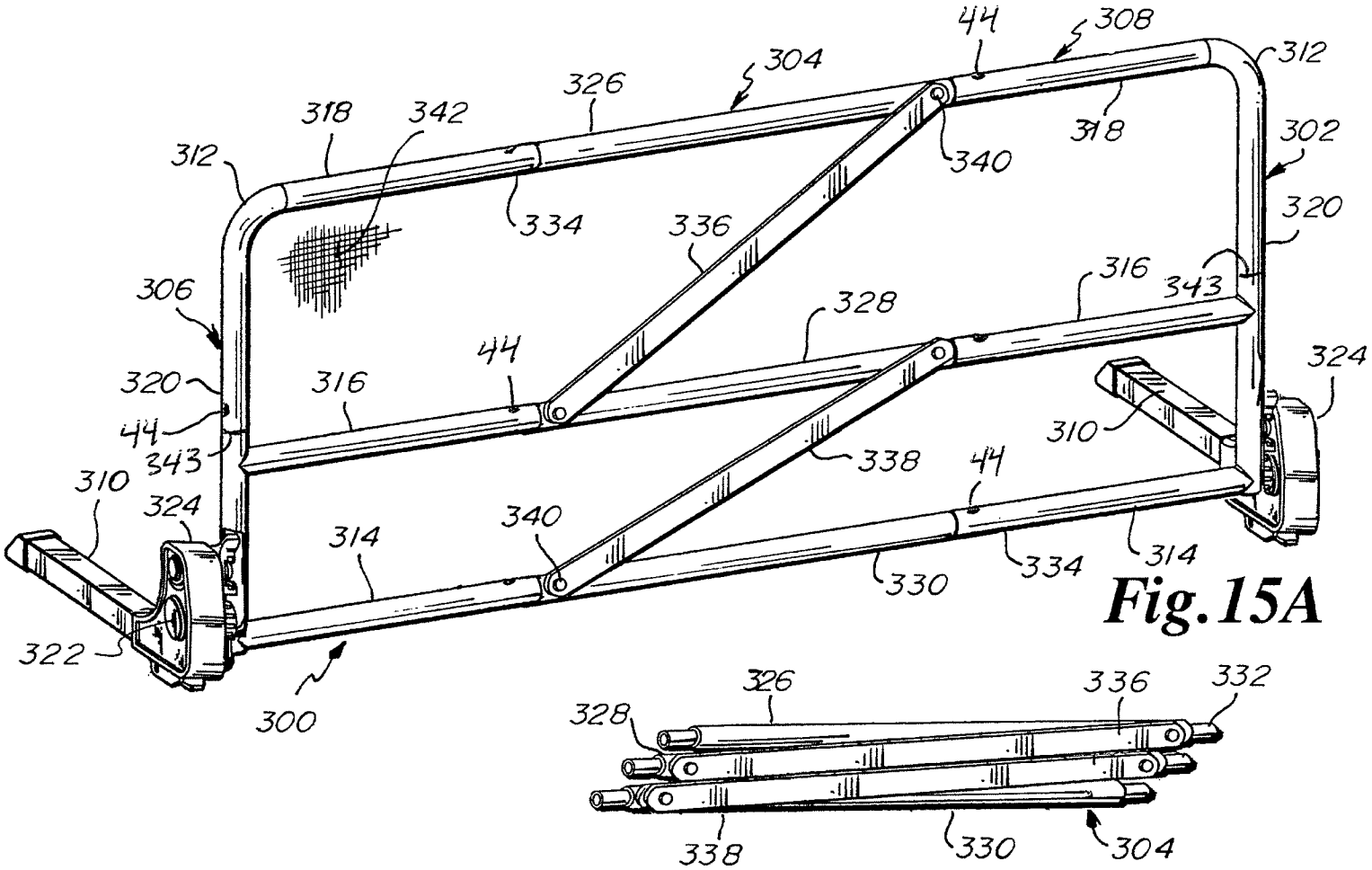
FIG. 15A is a perspective view of a bed rail having all center tubes connected to each other such that one center tube is not left out during assembly, where the connection among the center tubes is an accordian closure.
FIG. 15B is a perspective view of the center tubes of FIG. 15A folded for shipping and storage.

The Embodiment of FIGS. 15A and 15B

FIG. 15A is a front perspective view of a bed rail 300 having a guard frame 302 with a removable central portion 304 interconnecting a first end frame portion 306 with a second end frame portion 308. Bed rail 300 further includes a pair of legs 310 pivotally mounted to the guard frame 302.

End portion or one-piece left side 306 includes an L-shaped tube or support member 312, a lower tube or horizontally extending support member 314, and a middle or intermediate tube or horizontally extending support member 316. Middle tube 316 lies in the plane of the sleeping surface of a bed when the legs 310 are disposed between the mattress and box spring of the bed. L-shaped tube 312 includes an upper horizontally extending portion or upper tube portion 318 and a vertically extending portion or vertical tube portion 320. Each of the inner ends of the lower tube 314, middle tube 316 and upper tube portion 318 is preferably a female end.

Guard frame 302 further includes end portion 308 or one-piece right side 308 that is identical to the end portion 306 or one-piece left side 306.

Each of the left side and right side guard frame portions 306, 308 have a pivot portion 322 that may be integral and one-piece with lower tube 314. Pivot portion 322 projects outwardly beyond the vertically extending portion 320 of left side L-shaped tube 312 and beyond the vertically extending portion 320 of the L-shaped tube of right side piece 302. Pivot portion 322 serves to mount a pivot junction or pivot housing 324 on a proximal end of leg 310. Junction or housing 324 can lock the guard frame 302 in an up position confronting the side of a bed and projecting beyond the sleeping surface of a bed to prevent a child from rolling off the sleeping surface. Junction or housing 324 can permit the guard frame 302 to swing away from the sleeping surface and swing down to a down position confronting the side of a bed, i.e., to a position about 180 degrees from the up position. As to junction or housing 324 in FIGS. 15A and 16A, U.S. Provisional Patent Application No. 61/406,995 filed Oct. 26, 2010 and U.S. patent application Ser. No. 13/253,871 filed Oct. 5, 2011 are hereby incorporated by reference in their entireties. With such a junction 324, a proximal end of a flexible member 78 is operatively engaged to a buckle 106 (shown in FIG. 6) mounted on the underside of junction 324, and the distal end of the flexible member 78 is engaged to the counter member or anchor 70 such that, by pulling on the proximal end of flexible member 78 adjacent the first side of the bed 16, the distal end of anchor 70 is pulled tightly against the second side of the bed 16.

Guard frame 302 further includes upper, intermediate or middle, and lower center tubes or horizontal support members 326, 328, 330. Each of the outer ends of each of the tubes 326, 328, 330 is a male end 332 that mates with the respective inner female end 334 of tubes 318, 316, 314 of the left side and right side portions 306, 308.

It should be noted that, if desired, center tubes 326, 328 and 330 may have female outer ends and that respective tubes or tube portions 318, 316, 314 may have male ends, or there may be some combination of female/male ends, where left side portion 306 has one type of either male or female ends and where right side portion 308 has the other type of either male or female ends. Or each of upper, middle and lower center tubes 326, 328, 330 can have one type of male and female ends at its left side and the same or other type of male and female ends at its right side. A male/female type of connection is preferred because such adds strength to a multi-piece tube arrangement, i.e., the male portion extends for a substantial longitudinal distance into the female ends.

Each of the male/female couplings in this embodiment overlaps for an effective distance in the axial or horizontal direction to provide a lateral or transverse strength to the interconnection. Such an effective distance is preferably more than one inch, more preferably more than two inches, even more preferably more than three inches, and yet more preferably more than four inches. Such an effective distance is preferably less than 12 inches.

If desired, the male ends of the tubes 326, 328, and 330 may include buttons 44 to engage six respective button receiving openings that may be formed at the inner ends 334 of tubes 314, 316, and 318 of the left and right side portions 306, 308. If the male ends are on the inner ends, such male inner ends may have buttons 44 and the respective outer ends of members 326, 328 and 330 may include button receiving openings.

Frame central portion 304 includes the three center tubes or horizontally extending support members 326, 328, 330, further includes a first rigid member 336 pivotally engaged between upper and middle tubes 326 and 328, and further includes a second rigid member 338 pivotally engaged between middle and lower tubes 328 and 330. The purpose of the first and second rigid members 336, 338 is to interconnect the three center tubes 326, 328 and 330 such that a user assembling the bed rail 300 does not leave out one of the center tubes 326, 328, 330 during assembly. The engagement between the rigid members 336 and 338 and the three center tubes 326, 328, 330 is permanent such that rigid members 336, 338 cannot be removed from center tubes 326, 328, 330 without destroying the integrity of any such tubes or the integrity of the central portion 304.

Rigid member 336, such as a bar or flat metal strip, includes an upper end that is pivotally affixed to an end of upper center tube 326. Rigid member 336 includes a lower end that is pivotally affixed to an end of middle center tube 328. One end of rigid member 336 confronts end frame portion 306. The other end of rigid member 336 confronts end frame portion 308.

Rigid member 338, such as a bar or flat metal strip, includes an upper end that is pivotally affixed to an end of middle center tube 328. Rigid member 338 includes a lower end that is pivotally affixed to an end of lower center tube 330. One end of rigid member 338 confronts end frame portion 306. The other end of rigid member 338 confronts end frame portion 308.

The pivotal engagement between rigid members 336, 338 and their respective center tubes 326, 328, 330 includes a pivot pin 340 extending through the respective rigid member 336, 338 and into the respective center tube 326, 328, 330.

Rigid members 336, 338 are straight or rectilinear and run in an oblique manner relative to each other, not a parallel manner relative to each other. The oblique relationship stems from upper tube 326 lying at a first distance from middle tube 328, from lower tube 330 lying at a second distance from middle tube 328, and from such first and second distances being different from each other. Upper, middle and lower tubes 326, 328, 330 run parallel to each other.

Rigid members 336, 338 also run obliquely relative to each of the upper, intermediate, and lower tubes 326, 328, 330.

Upper, middle and lower tubes 326, 328, 330 are coplanar when engaged between end portions 306, 308. Further, a front tangential plane set on a front face of central portion 304 when engaged between end portions 306, 308 tangentially engages upper, middle and lower tubes 326, 328, 330. It is in this front tangential plane that the rigid members 336, 338 extend.

As shown in FIG. 15B, central frame portion 304 folds to a compact, folded configuration for shipping and storage. In this compact, folded configuration, male ends 332 of one end of the central portion 304 confront each other and are staggered or offset from each other, and male ends 332 of the other end of the central portion 304 confront each other and are staggered or offset from each other. Further, in this compact, folded configuration, the upper end of rigid member 336 confronts and is offset from the upper end of rigid member 338, and the lower end of rigid member 336 confronts and is offset from the lower end of rigid member 338.

In the folded open and operating position of bed rail 300, tube portion 318 of end portion 306, tube 326 and tube portion 318 of end portion 308 are coaxial. Tube 316 of end portion 306, tube 328 and tube 316 of end portion 308 are coaxial. Tube 314 of end portion 306, tube 330 and tube 314 of end portion 308 are coaxial.

Guard frame 302 includes a flexible wall or sheeting 342 interconnected among the central portion 304 and end portions 306, 308.

Guard frame 302 can include the counter members 70 engaged to the legs 310 with flexible straps or members 78.

Instead of flexible straps or members 78, rigid members or telescoping members may be utilized between legs 310 and counter members 70.

Vertical side member 320 is preferably one-piece. However, if desired, as shown by junction 343, vertical member 320 may be broken down into two pieces, with such two pieces being engagable together by having a male/female connection, which is shown by the button 44 of the lower piece being engaged in a button receiving hole formed in the upper piece. By making the vertical side member 320 two pieces, the bed rail of FIGS. 15A and 15C may be shipped and stored in a smaller box. The separation of the one piece vertical member 320 is made at a location that confronts middle tube 316. In the embodiment of FIGS. 15A and 15B, the invention includes a bed rail that includes a) a guard rail frame for confronting a side of a bed for preventing a child from rolling off the bed; b) first and second legs engaged to the guard rail frame such as through a junction, with the first and second legs being disposed horizontally to extend between a mattress and box spring of the bed; c) wherein the guard rail frame includes a pair of first and second end frame portions; d) wherein each of the first and second end frame portions includes upper, lower and intermediate horizontal support members; e) a central frame portion, with the central frame portion includes upper, lower and intermediate horizontal support members; f) wherein the upper, lower and intermediate horizontal support members of the central frame portion are engagable to the upper, lower and intermediate horizontal support members of the first and second end frame portions; and g) wherein the upper, lower and intermediate horizontal support members of the central frame portion are engaged to each other. The invention further includes the upper, lower and intermediate horizontal support members of the central frame portion being pivotally engaged to each other. The invention further includes the upper and intermediate horizontal support members of the central frame portion being pivotally engaged to each other via a first piece extending from one end of the upper horizontal support member of the central frame portion to one end of the intermediate horizontal support member of the central frame portion, with the first piece being oblique relative to each of the upper and intermediate horizontal support members of the central frame portion. The invention further includes the lower and intermediate horizontal support members of the central frame portion being pivotally engaged to each other via a second piece extending from one end of the lower horizontal support member of the central frame portion to one end of the intermediate horizontal support member of the central frame portion, with the second piece being oblique relative to each of the lower and intermediate horizontal support members of the central frame portion.

Figures 16A, 16B:
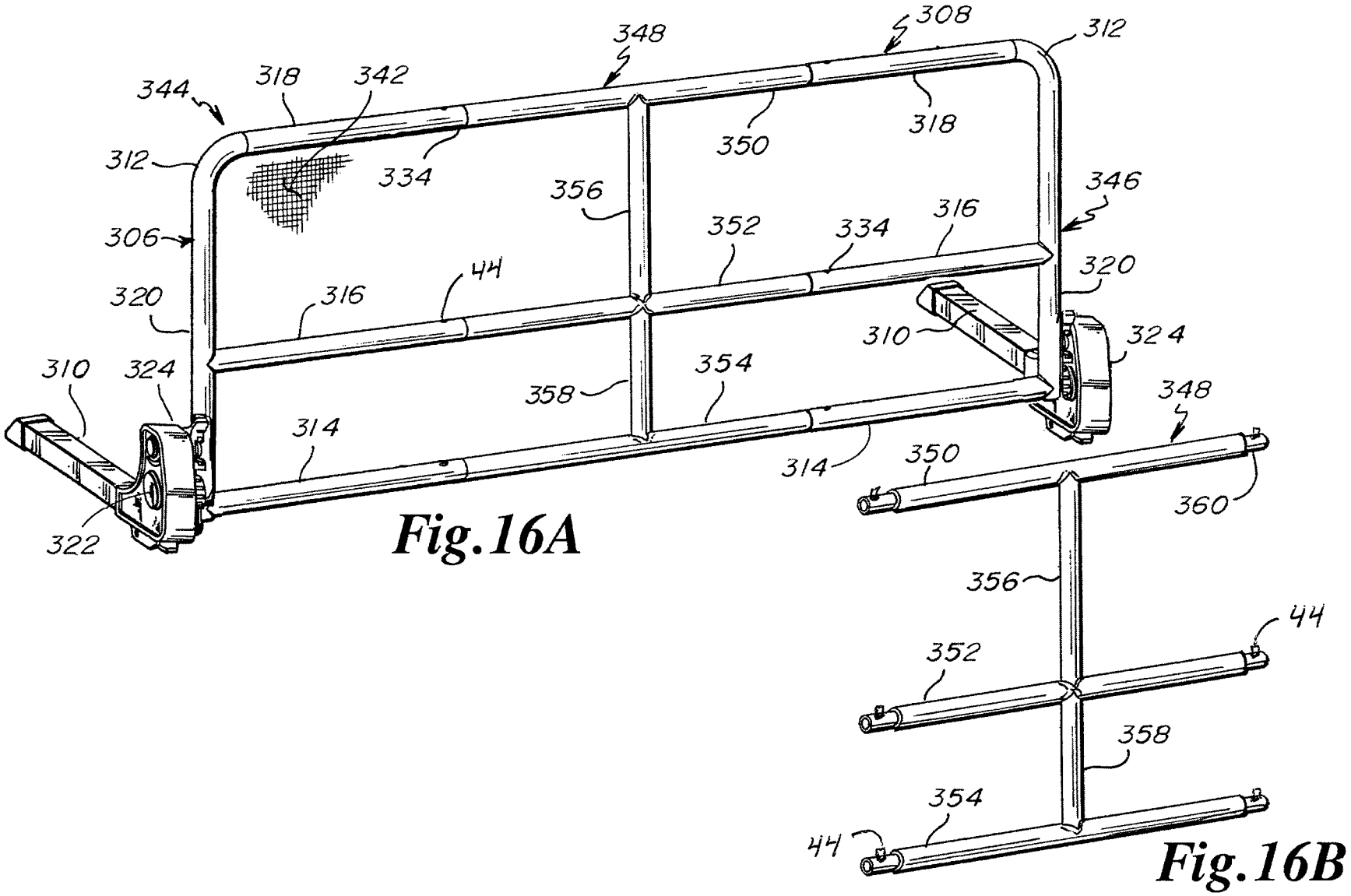
FIG. 16A is a perspective view of a bed rail having all center tubes connected to each other such that one center tube is not left out during assembly, where the connection among the center tubes is fixed and rigid.
FIG. 16B is a detail view of the center tubes of FIG. 16A showing welds between horizontal center tubes and rigid, fixed vertical support members.

The Embodiment of FIGS. 16A and 16B

FIG. 16A is a front perspective view of a bed rail 344 having a guard frame 346 with a removable central portion 348 interconnecting first end frame portion 306 with second end frame portion 308. First and second end frame portions 306, 308 of bed rail 344 is identical to first and second end frame portions 306, 308 of bed rail 300. Bed rail 344 further includes the pair of legs 310 pivotally mounted to the guard frame 346 such as through junction 324.

While bed rail 300 of FIG. 15A includes removable central portion 304, bed rail 344 of FIG. 16A includes removable central portion 348. Central portion 304 is engagable in bed rail 344 of FIG. 16A if desired. Central portion 348 is engagable in bed rail 300 of FIG. 15A if desired. Also, center tubes 146, 148, 150 of package 164 of bed rail 152 of FIG. 12A may be utilized in either of bed rails 300 or 344 where package 164 replaces central portion 304 or 348 with a modification of the male/female ends. Conversely, either of the central portions 304, 348 may replace package 164 in bed rail 152 of FIG. 12A with a modification of the male/female ends.

Removable central portion 348 includes an upper center tube or horizontally extending support member 350, an intermediate or middle center tube or horizontally extending support member 352, and a lower center tube or horizontally extending support member 354. Removable central portion 348 further includes a vertically extending upper center post or tube 356 and a vertically extending lower center post or tube 358. Upper and lower portions of upper post 356 are welded to upper and middle center tubes 350, 352, respectively. Upper and lower portions of lower post 358 are welded to middle and lower center tubes 352, 354, respectively. Posts 356, 358 are coaxial.

Removable central portion 348 is composed of five tubes welded together to prevent a user or consumer from forgetting to install one tube such as a horizontally extending center tube. Removable central portion 348 is one-piece. None of the portions 350, 352, 354, 356, 358 can be separated or disengaged from any of its adjoining portions without destroying the integrity of such portions or the integrity of the removable central portion 348 as a whole.

Center tubes 350, 352, 354 run parallel to each other and at right angles to each of the center posts 356, 358. Each of center tubes 350, 352 and 354 are straight or rectilinear. Each of the center posts 356, 358 are straight or rectilinear.

Instead of separate center posts 356, 358, a single center post may be utilized. In such a case where a single center post is utilized, such single center post may be slide through an opening formed centrally in middle center tube 352 and be welded to the middle center tube 352 at surfaces adjoining the opening.

Each of the outer ends of upper, middle and lower center tubes 350, 352, 354 is a male end 360. Male ends 360 engage female ends 334 of end portions 306, 308.

As with bed rail 300, male ends 360 and female ends 334 may be mixed and matched. In other words, it should be noted that, if desired, center tubes 350, 352, 354 may have female outer ends and that respective tubes or tube portions 318, 316, 314 may have male ends, or there may be some combination of female/male ends, where left side portion 306 has one type of either male or female ends and where right side portion 308 has the other type of either male or female ends. Or each of upper, middle and lower center tubes 350, 352, 354 can have one type of male and female ends at its left side and the same or other type of male and female ends at its right side. A male/female type of connection is preferred because such adds strength to a multi-piece tube arrangement, i.e., the male portion extends for a substantial longitudinal or axial distance into the female ends.

Each of the male/female couplings in this embodiment overlaps for an effective distance in the axial or horizontal direction to provide a lateral or transverse strength to the interconnection. Such an effective distance is preferably more than one inch, more preferably more than two inches, even more preferably more than three inches, and yet more preferably more than four inches. Such an effective distance is preferably less than 12 inches.

Like the embodiments of FIGS. 12A and 12B, of FIG. 14, and of FIGS. 15A and 15B, the male and female ends may interconnect with the use of buttons 44 and the use of cooperating button receiving openings for buttons 44.

Further, it should be noted that, whatever the combination of female or male ends, and whether or not such ends include buttons and button receiving openings, or of any other type of connection, the exposed ends of end portion 306 are preferably not connectable or engagable with the exposed ends of end portion 308 such that a user cannot connect end portion 306 to end portion 308. With the embodiments shown in FIGS. 15A, 15B, 16A and 16B, the end portions 306, 308 have female openings such that end portions 306, 308 are not connectable to each other. However, if desired, end portions 306, 308 can have cooperating male/female ends such that end portions 306, 308 can be connectable to each other where a bed rail of a lesser length is desired.

In bed rail 344, tube portion 318 of end portion 306, tube 350 and tube portion 318 of end portion 308 are coaxial. Tube 316 of end portion 306, tube 352 and tube 316 of end portion 308 are coaxial. Tube 314 of end portion 306, tube 354 and tube 314 of end portion 308 are coaxial.

Guard frame 346 includes the flexible wall or sheeting 342 interconnected among the central portion 348 and end portions 306, 308.

Guard frame 346 can include the counter members 70 engaged to the legs 310 with flexible straps or members 78. Instead of flexible straps or members 78, rigid members or telescoping members may be utilized between legs 310 and counter members 70.

In the embodiment of FIGS. 16A and 16B, the invention includes a bed rail comprising: a) a guard rail frame for confronting a side of a bed for preventing a child from rolling off the bed; b) first and second legs engaged to the guard rail frame such as through a junction, with the first and second legs being disposed horizontally to extend between a mattress and box spring of the bed; c) wherein the guard rail frame includes a pair of first and second end frame portions; d) wherein each of the first and second end frame portions includes upper, lower and intermediate horizontal support members; e) a central frame portion, with the central frame portion comprising upper, lower and intermediate horizontal support members; f) wherein the upper, lower and intermediate horizontal support members of the central frame portion are engagable to the upper, lower and intermediate horizontal support members of the first and second end frame portions; and g) wherein the upper, lower and intermediate horizontal support members of the central frame portion are engaged to each other. The invention further includes the upper and intermediate horizontal support members of the central frame portion being rigidly engaged to each other with a vertical post. The invention further includes the lower and intermediate horizontal support members of the central frame portion being rigidly engaged to each other with a vertical post. The invention further includes the upper, lower and intermediate horizontal support members of the central frame portion being rigidly engaged to each other by at least one vertical post extending to each of the upper, lower and intermediate horizontal support members of the central frame portion.

Interchangeability Among Embodiments

A part or parts from one embodiment may be added to another embodiment. A part or parts from one embodiment may be replaced with a part or parts of another embodiment. In other words, a bed rail or guard frame according to the invention may feature a first part from a first embodiment, a second part from a second embodiment, a third part from a third embodiment, a fourth part from a fourth embodiment, and so on. For example, the frame of bed rail 172 of FIG. 13B may include either of the tension locks of FIG. 10B or 11. Or, for example, the frame of bed rail 172 of FIG. 13B may be replaced with the guard frames of FIG. 12A or FIG. 1C or the guard frame of any other Figure. Or, for example, the pivot portions 220, junctions 224 and legs 206 of FIG. 14 can replace the structures of the other Figures. Or, for example, the guard frame 202 of FIG. 14 can replace the guard frames of the other Figures.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A bed rail comprising:

a) a guard rail frame for confronting a side of a bed for preventing a child from rolling off the bed;

b) first and second legs engaged to the guard rail frame, with the first and second legs being disposed horizontally to extend between a mattress and mattress support of the bed;

c) wherein the guard rail frame includes a pair of first and second end frame portions;

d) wherein each of the first and second end frame portions includes upper, lower and intermediate horizontal support members;

e) a central frame portion, with the central frame portion comprising upper, lower and intermediate horizontal support members;

f) wherein the upper, lower and intermediate horizontal support members of the central frame portion are engagable to the upper, lower and intermediate horizontal support members of the first and second end frame portions;

g) wherein the upper, lower and intermediate horizontal support members of the central frame portion are engaged to each other;

h) the upper, lower and intermediate horizontal support members of the central frame portion are rigidly engaged to each other, with a first rigid member portion extending from the upper horizontal support member of the central frame portion to the intermediate horizontal support member of the central frame portion, and with a second rigid member portion extending from the intermediate horizontal support member of the central frame portion to the lower horizontal support member of the central frame portion;

i) wherein the central frame portion is one-piece such that none of the upper, lower and intermediate horizontal support members of the central frame portion can be separated from the central frame portion without destroying an integrity of the central frame portion, and such that none of the first rigid member portion and second rigid member portion can be separated from the central frame portion without destroying an integrity of the central frame portion;

j) wherein the first and second rigid member portions are coaxial; and k) wherein the central frame portion is engaged to the upper, lower and intermediate horizontal support members of the first and second end frame portions by one of male ends and female ends of the upper, lower and intermediate horizontal support members of the first and second end frame portions engaging the other of male ends and female ends of the central frame portion such that said male end extends into the female end for an axial distance.

2. The bed rail according to claim 1, wherein the first rigid member portion is welded to the upper horizontal support member of the central frame portion and further welded to the intermediate horizontal support member of the central frame portion, and wherein the second rigid member portion is welded to the intermediate horizontal support member of the central frame portion and further welded to the lower horizontal support member of the central frame portion.

3. The bed rail according to claim 1, wherein one of the male and female ends includes a button and wherein the other of the male and female ends includes an opening that engages the button such that the central frame portion is releaseably engagable to each of the first and second end frame portions.

4. The bed rail according to claim 1, wherein the guard rail frame is swingably engaged to each of the first and second legs.

* * * * *